US010351801B2

(12) United States Patent
Martinez-Crowley et al.

(10) Patent No.: US 10,351,801 B2
(45) Date of Patent: Jul. 16, 2019

(54) LEATHER AND/OR VINYL CLEANER AND MOISTURIZER AND METHOD OF MAKING SAME

(71) Applicant: Ecolab USA Inc., Saint Paul, MN (US)

(72) Inventors: Melissa Martinez-Crowley, Saint Paul, MN (US); Katie Gaynor, Saint Paul, MN (US); Jeffrey John Biggs, Saint Paul, MN (US); Stephen Todd Smith, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 67 days.

(21) Appl. No.: 15/633,395

(22) Filed: Jun. 26, 2017

(65) Prior Publication Data

US 2017/0306265 A1 Oct. 26, 2017

Related U.S. Application Data

(63) Continuation of application No. 14/717,098, filed on May 20, 2015, now Pat. No. 9,719,053, which is a (Continued)

(51) Int. Cl.
*C11D 9/36* (2006.01)
*C11D 1/94* (2006.01)

(Continued)

(52) U.S. Cl.
CPC ..... *C11D 1/94* (2013.01); *C11D 1/667* (2013.01); *C11D 1/72* (2013.01); *C11D 1/825* (2013.01);

(Continued)

(58) Field of Classification Search
CPC ..... C11D 3/373; C11D 17/0017

(Continued)

(56) References Cited

U.S. PATENT DOCUMENTS 4,810,407 A 3/1989 Sandvick
5,302,658 A 4/1994 Gee et al.

(Continued)

FOREIGN PATENT DOCUMENTS

EP 1566433 8/2005
EP 1632521 3/2006

(Continued)

OTHER PUBLICATIONS

International Searching Authority,"Notffication of Transmittal of the International Search Report and the Written Opinion" issued in connection to International Application No. PCT/US2013/064746, dated Jan. 24, 2014.

(Continued)

*Primary Examiner* — Gregory E Webb
(74) *Attorney, Agent, or Firm* — McKee, Voorhees & Sease, PLC

(57) ABSTRACT

The present invention comprises a hard surface cleaning and treatment composition with a synergistic combination of mild surfactants that makes the composition particularly suited for leather, synthetic leather, vinyl and stainless steel. The composition is gentle and non-damaging to leather and synthetic leather, and leaves no sticky residue. The composition can clean food soils such as mustard, ketchup, shortening and grease and requires no personal protective equipment when being used. In addition, a method of preserving a leather surface or article by contacting said surface with said substrate is disclosed as well as specific methods associated with making the composition to form a stable water in oil emulsion.

21 Claims, 11 Drawing Sheets

Related U.S. Application Data continuation of application No. 13/652,009, filed on Oct. 15, 2012, now Pat. No. 9,062,282.

(51) Int. Cl.

| | |
|---|---|
| ***C11D 3/37*** | (2006.01) |
| ***C11D 1/66*** | (2006.01) |
| ***C11D 1/72*** | (2006.01) |
| ***C11D 1/825*** | (2006.01) |
| ***C11D 3/00*** | (2006.01) |
| ***C11D 3/16*** | (2006.01) |
| ***C11D 3/30*** | (2006.01) |
| ***C11D 1/90*** | (2006.01) |
| ***C11D 3/22*** | (2006.01) |
| ***C11D 17/00*** | (2006.01) |

(52) U.S. Cl.

CPC ..... *C11D 1/90* (2013.01); *C11D 3/0031* (2013.01); *C11D 3/162* (2013.01); *C11D 3/222* (2013.01); *C11D 3/30* (2013.01); *C11D 3/373* (2013.01); *C11D 3/3703* (2013.01); *C11D 17/0017* (2013.01)

(58) Field of Classification Search

USPC ..... 510/275, 417, 466

See application file for complete search history.

(56) References Cited

U.S. PATENT DOCUMENTS

| | | | | |
|---|---|---|---|---|
| 6,506,715 | B1 | 1/2003 | Schultz et al. | |
| 6,750,188 | B2 | 6/2004 | Baker et al. | |
| 6,972,277 | B2 | 12/2005 | Dietz | |
| 7,229,486 | B2 | 6/2007 | Wiersema et al. | |
| 7,319,119 | B2 | 1/2008 | Mahr et al. | |
| 7,378,382 | B2 | 5/2008 | Serobian et al. | |
| 7,381,250 | B2 | 6/2008 | Hasinovic et al. | |
| 7,541,320 | B2 | 6/2009 | Dabkowski et al. | |
| 2005/0065059 | A1 | 3/2005 | Roselle et al. | |
| 2005/0187121 | A1 | 8/2005 | Dietz | |
| 2005/0250668 | A1 | 11/2005 | Serobian et al. | |
| 2005/0267223 | A1 | 12/2005 | Schlicht et al. | |
| 2006/0150863 | A1 | 7/2006 | Ueda et al. | |
| 2007/0163463 | A1 | 7/2007 | Hasinovic et al. | |
| 2008/0171683 | A1* | 7/2008 | Johnson | C11D 3/0031 510/275 |
| 2008/0196168 | A1 | 8/2008 | Schubert et al. | |
| 2010/0137454 | A1 | 6/2010 | Barmes et al. | |
| 2011/0150787 | A1 | 6/2011 | Gonzales et al. | |
| 2011/0150949 | A1* | 6/2011 | Gonzales | C11D 3/3749 424/401 |
| 2012/0020909 | A1 | 1/2012 | Courel et al. | |
| 2014/0102475 | A1* | 4/2014 | Martinez-Crowley | C11D 1/667 134/6 |

FOREIGN PATENT DOCUMENTS

| | | |
|---|---|---|
| JP | 2009040923 | 2/2009 |
| WO | 9700934 | 1/1997 |
| WO | 9910464 | 3/1999 |
| WO | 2007070713 | 6/2007 |
| WO | 2009128883 | 10/2009 |
| WO | 2012018403 | 2/2012 |

OTHER PUBLICATIONS

European Patent Office, "Partial Supplementary European Search Report", issued in connection to application No. 13846953.1, PCT/US2013/064746, Ecolab USA Inc., dated Jun. 1, 2016.

* cited by examiner

LEATHER AND/OR VINYL CLEANER AND MOISTURIZER AND METHOD OF MAKING SAME

CROSS REFERENCE TO RELATED APPLICATIONS

This is a Continuation Application of U.S. Ser. No. 14/717,098 filed May 20, 2015, which is a continuation of U.S. Ser. No. 13/652,009 filed Oct. 15, 2012, now U.S. Pat. No. 9,062,282, issued Jun. 23, 2015, all of which are herein incorporated by reference in their entirety.

FIELD OF THE INVENTION

The present invention relates to the field of hard surface cleaning compositions particularly for leather and vinyl surfaces. In particular, the invention relates to leather and vinyl surface cleaning and treatment composition including silicone and a specific combination of mild surfactants which are effective at cleaning food stains, which do not damage leather or vinyl surfaces and which do not require protective equipment to use.

BACKGROUND OF THE INVENTION

Cleanability of booth surfaces in Quick Service Restaurants (QSR) is becoming increasingly challenging as new décor types are being implemented globally into store remodels and new builds. Black soot soiling of deeply imprinted soft vinyl décor and upholstery fabrics offers the largest cleaning challenge.

Many commercial products are currently available for cleaning and conditioning plastic, leather, and vinyl surfaces such as furniture coverings, clothing, items, shoes, automobile interiors, saddles and bridles, fashion accessories such as belts and handbags, and the like. Generally such products incorporate a mineral oil-based soap which is manually applied and worked into the surface with a brush, and thereafter rinsed with water. These soaps tend to be quite irritating to the skin of the user, and moreover are not generally biodegradable. A more user and environmentally friendly cleaner and conditioner is needed for vinyl, plastic and leather, particularly as such surfaces are used in the quick service restaurant industry.

Mineral oil, interferes with the natural oils found in leather, extracting the same; eventually causing cracks and drying of the surface. Silicone oil has been used to lubricate and give such materials sheen or glow. Silicone oil does not interact with the natural oils found in leather or synthetic oils found in vinyl like other oils such as mineral oil. In addition to silicone oil for lubrication, other ingredients are needed in order to clean the surface, since leather is sensitive to pH and chemical composition such as acids and alkaline, corrosive and caustic materials, surfactants with mild composition and no caustic/alkaline ingredients are needed to be implemented to clean fatty soils like the ones encountered in quick service restaurants such as shortening and hamburger grease.

It would be desirable to formulate a leather, vinyl and plastic cleaner and conditioner which could be more easily applied, would be non-toxic and non-irritating to the user, and which would be biodegradable, particularly for use in the quick service industry.

BRIEF SUMMARY OF THE INVENTION

The present invention comprises a hard surface cleaning and treatment composition with a synergistic combination of mild surfactants that makes the composition particularly suited for leather, synthetic leather, vinyl and stainless steel. The composition is gentle and non-damaging to leather and synthetic leather, and leaves no sticky residue. The composition can clean non-trans fat soils, and food soils such as mustard, ketchup, as well as shortening and grease. The composition also does not requires personal protective equipment when being used. The composition can be employed to clean leather and vinyl surfaces such as furniture, upholstery, clothing, shoes, belts, automobile upholstery and the like. In addition, a method of preserving a leather surface or article by contacting said surface with said substrate is disclosed.

The composition uses silicone to protect and moisturize along with a specific mild surfactant combination and an emulsifier/stabilizer that prevents damage to leather, that is safe for the user, all while providing strong cleaning properties. Surfactants present in the invention include Cocamidopropylbetaine, Polyoxyethylene (20) Sortbitan Monooleate, and a C10-C12 alcohol with 6 moles of ethoxylate. Other components include an amine as an emulsifier/stabilizer and an optional preservative. The composition may also include a fragrance and thickener.

In another embodiment, the present invention is a method of removing soils from a surface such as leather, vinyl or stainless steel. The method includes diluting a cleaner with water of dilution to form a use solution and contacting the surface with the use solution. In one embodiment, the cleaner includes a cleaning composition with silicone and a surfactant comprising a combination of cocamidopropylbetaine and polyoxyethylene (20) sorbitan monoleate, a C10 to C12 alcohol with 3-6 moles of ethoxylate, an emulsifier or stabilizer and a preservative. The use solution is capable of removing food and oily soils while also moisturizing the surface and leaving no sticky residue upon drying.

In another aspect of the present invention, a process for treating a leather article comprising the step of contacting the leather article with a treating composition comprising silicone with a surfactant comprising a combination of cocamidopropylbetaine and polyoxyethylene (20) sorbitan monoleate, an emulsifier or stabilizer and a preservative where the appearance of the leather article is not damaged as compared to its original appearance prior to contacting with the treating composition, is provided.

In another aspect, the invention is directed to a method of cleaning, preserving and protecting a leather surface that comprises the steps of: contacting a leather surface with an effective cleaning amount of a cleaning composition comprising i) from about 0.3% to about 20%, based on weight of the cleaning composition, of a silicone derivative selected from the group consisting of polysiloxane copolymers, silicone-acrylate copolymers, silicone oils, amino-substituted silicone copolymer derivatives, and mixtures thereof; ii) from about 0.027% to about 0.05%, based on weight of the cleaning composition, of at least one stabilizer; iii) from about 4% to about 20%, based on weight of the cleaning composition, of at least one detersive surfactant selected from the group consisting of cationic, zwitterionic, amphoteric, nonionic or mixtures thereof wherein said surfactants are mild and non-irritating to the user; iv) a preservative from about 0.12% to about 0.17%, based on weight of the cleaning composition, with any remainder being water and wiping said surface with a cloth or disposable substrate. In a preferred embodiment the surfactants include a combination of C10-C12 alcohol with 3-6 moles of ethylene oxide, cocamidopropylbetaine, and polyoxyethylene (20) sorbitan monooleate. Also the formulation requires a thickener such as xanthum gum to ensure a stable formulation.

The invention also includes a specific engineering process with the emulsifier/thickener to maintain a stable emulsion. First, the thickener, preferably Xanthan Gum must be fully hydrated before combining with poly dimethylsiloxane and second polydimethylsiloxane must be blended with surfactants, fragrance, and buffering agent before combining with water.

Achieving such a stable emulsion was quite surprising as generally, macro emulsions are thermodynamically unstable and surfactants can be used, stoichiometrically, to stabilize by reducing surface tension. However, the quantities of surfactants used in this formulation are in excess of the stoichiometric quantities, for the purpose of providing additional detergency in for the end use.

Applicants achieved stable polydimethylsiloxane and surfactant premix by emulsifying water inside. Unexpectedly, making the water in oil emulsion first made the most stable finished product. Then, the amount of water was reduced to 30% of inversion point and still achieved a stable water-in-oil premix, and a stable final product. This emulsion is quite unique in that the oil droplets in the final formula are not coalescing, and this creates a stable emulsion without high shear, and a stable emulsion without stoichiometric ratio of surfactants:polydimethylsiloxane While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE INVENTION

Figure 1:
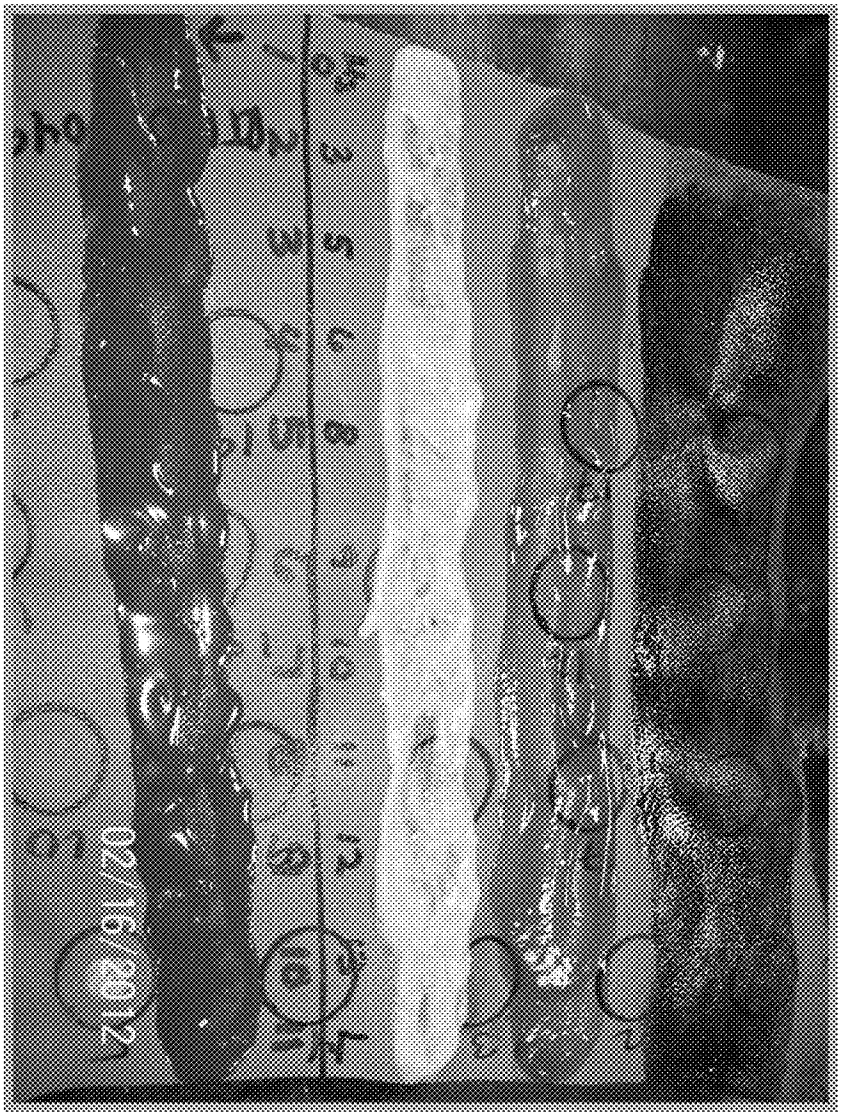
FIG. 1 is a photograph showing the initial performance screening of several test formulations.

Other than in the operating examples, or where otherwise indicated, all numbers expressing quantities of ingredients or reaction conditions used herein are to be understood as being modified in all instances by the term "about".

The term "leather article" herein means any article that comprises wholly or partially, a material which is composed of an animal hide or skin that is tanned or treated such that the material is imputrescible. Examples of leather articles are grain leather articles and/or suede leather articles.

The term "finished leather article" herein means a leather article which has been processed (i.e., finished) in a way that adds value to a consumer (i.e., a purchaser of the finished leather article). Nonlimiting examples of finished leather articles include, leather garments (i.e., skirts, coats, pants), leather accessories (i.e., belts, gloves, bags, purses, shoes), and leather furniture/upholstery (i.e., leather chairs, leather sofas, linen, drapery, furniture covers), tarpaulins and the like. Such finished leather articles are customarily cleaned in a conventional laundry process and/or in a dry cleaning process.

The term "deleterious effect" and/or "damage" to the leather article herein means that the physical and/or aesthetic properties of the finished leather article have been negatively impacted. Such deleterious effects may occur in the structure and/or integrity of the finished leather article and/or on the finished surface of the finished leather article. Nonlimiting examples of deleterious effects on finished leather articles include shrinkage, cracking, discoloring, loss of suppleness and/or loss of feel. Once a deleterious effect has occurred to a finished leather article, the finished leather article typically loses value to the owner of the finished leather article because the owner may cease or reduce the use of the finished leather article.

The terms "leather article cleaning composition" and/or "leather article treating composition" used herein are intended to mean any composition, especially a lipophilic fluid-containing composition, which comes into direct contact with leather articles to be cleaned and/or treated. It should be understood that the term encompasses uses other than cleaning, such as conditioning and sizing. Furthermore, optional cleaning adjuncts such as additional surfactants other than those surfactants described above, bleaches, and the like may be added to the "treating composition". That is, cleaning adjuncts may be optionally combined with the lipophilic fluid. These optional cleaning adjuncts are described in more detail herein below. Such cleaning adjuncts may be present in the treating compositions of the present invention at a level of from 0.01% to about 10% by weight of the treating composition.

The term "soil" means any undesirable substance on a leather article that is desired to be removed. In a food service area this can include mustard, ketchup, grease and fat from food substances, cooking grease, protein and the like.

As used herein, weight percent (wt-%), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanyl, carbanyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "surfactant" or "surface active agent" refers to an organic chemical that when added to a liquid changes the properties of that liquid at a surface.

"Cleaning" means to perform or aid in soil removal, bleaching, microbial population reduction, rinsing, or combination thereof.

As used herein, the term "substantially free" refers to compositions completely lacking the component or having such a small amount of the component that the component does not affect the effectiveness of the composition. The component may be present as an impurity or as a contaminant and shall be less than 0.5 wt. %. In another embodiment, the amount of the component is less than 0.1 wt. % and in yet another embodiment, the amount of component is less than 0.01 wt. %.

As used herein, the term "hard surface" includes showers, sinks, toilets, bathtubs, countertops, windows, minors, transportation vehicles, floors, and the like. These surfaces can be those typified as "hard surfaces" (such as walls, floors, bed-pans)

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a alkyl phenol ethoxylate-containing cleaning to address a typical soiling condition on a typical substrate. This degree of cleanliness may, depending on the particular cleaning product and particular substrate, correspond to a general absence of visible soils, or to some lesser degree of cleanliness, as explained in the prior paragraph.

Compositions of the Invention

The compositions of the invention use silicone to protect and moisturize along with a specific mild surfactant combination and an emulsifier/stabilizer that prevents damage to leather. The compositions are safe for the user, while providing strong cleaning properties. Surfactants present in the invention preferably include Cocamidopropylbetaine, Polyoxyethylene (20) Sortbitan Monooleate, and a C10-C12 alcohol with 6 moles of ethoxylate. Other components include an amine as an emulsifier/stabilizer, a thickener and an optional preservative. The composition may also include a fragrance.

In one embodiment, the present invention is a method of removing soils from a surface such as leather, vinyl or stainless steel. The method includes diluting a cleaner with water of dilution if necessary, to form a use solution and contacting the surface with the use solution. In one embodiment, the cleaner includes a cleaning composition with silicone and a surfactant combination comprising a combination of cocamidopropylbetaine and polyoxyethylene (20) sorbitan monoleate, a C10 to C12 alcohol with 6 moles of ethoxylate, an emulsifier or stabilizer and a preservative. The use solution is capable of removing food and oily soils while also moisturizing the surface and leaving no sticky residue upon drying.

In another aspect of the present invention, a process for treating a leather article comprising the step of contacting the leather article with a treating composition comprising silicone with a surfactant comprising a combination of cocamidopropylbetaine and polyoxyethylene (20) sorbitan monoleate, an emulsifier or stabilizer and a preservative where the appearance of the leather article is not damaged as compared to its original appearance prior to contacting with the treating composition, is provided.

In another aspect, the invention is directed to a method of cleaning, preserving and protecting a leather surface that comprises the steps of: a) contacting a leather surface with a premoistened cleaning disposable substrate, said disposable substrate having incorporated therein an effective cleaning amount of b) a cleaning composition comprising i) from about 0.3% to about 20%, based on weight of the cleaning composition, of a silicone derivative selected from the group consisting of polysiloxane copolymers, silicone-acrylate copolymers, silicone oils, amino-substituted silicone copolymer derivatives, and mixtures thereof; ii) from about 0.027% to about 0.05%, based on weight of the cleaning composition, of at least one stabilizer; iii) from about 4% to about 20%, based on weight of the cleaning composition, of at least one detersive surfactant selected from the group consisting of cationic, zwitterionic, amphoteric, nonionic or mixtures thereof wherein said surfactants are mild and non-irritating to the user; iv) a preservative from about 0.12% to about 0.17%, based on weight of the cleaning composition, and an optional thickening agent with any remainder being water. In a preferred embodiment the surfactants include a combination of C10-C12 alcohol with 3 moles of ethylene oxide, cocamidopropylbetaine, and polyoxyethylene (20) sorbitan monooleate. Also the formulation requires a thickener such as xanthum gum to ensure a stable formulation.

Silicone Component

The cleaning/treatment composition of component comprises a silicone component selected from the group consisting of polysiloxane copolymers, silicone-acrylate copolymers, silicone oils, amino-substituted silicone derivatives, and mixtures thereof.

The silicone component of the cleaning composition of component can be silicone oils and are distinguished from silicone elastomers and resins, which are more thoroughly cross-linked than silicone oils. Suitable silicone oils include those based on organopolysiloxanes, these being selected from the class of polymers having the general formula (RnSiO((4−n)/2))m (I) wherein n is between 0 and 3 and m is 2 or greater, and R is alkyl or aryl, as defined in Silicone Compounds Register and Review, 5th Edition, R. Anderson, G. L. Larson and C. Smith Eds., Huls America Inc., Piscataway, N.J., p 247 (1991), which is hereby incorporated by reference. The value of m may be as large as one million or more, but more commonly has a value of between about 5 and 1000, these being readily flowable liquids with good handling properties and performance characteristics. These example silicone oils can be linear or branched. Various naming conventions and nomenclature that are essentially equivalent to this exemplary class of silicone oils, include, but are not limited to: dialkylpolysiloxane hydrolyzate; alpha-alkyl-omega-methoxypolydialkylsiloxane; polydialkyl silicone oil; poly(dialkylsiloxane); alkyl end-blocked polydialkylsiloxane; polyoxy(dialkylsilylene), alpha-(trialkylsilyl)-omega-hydroxy; poly[oxy(dialkylsilylene)], alpha-[trialkylsilyl]-omega-[(trialkylsilyl)oxy]; and alpha-(trialkylsilyl)poly[oxy(dialkylsilylene)]-omega-alkyl. Some additional suitable examples also include dimethicone copolyol, dimethylpolysiloxane, diethylpolysiloxane, high molecular weight dimethicone, mixed C1-C30 alkyl polysiloxane, phenyl dimethicone, dimethiconol, and mixtures thereof. Nonlimiting examples of silicone oils useful herein are also described in U.S. Pat. No. 5,011,681, to Ciotti et al., which is hereby incorporated by reference.

The silicone derivative of the cleaning composition of component b) i) can be polysiloxane copolymers. The polysiloxane copolymers useful herein also include polyalkyl or polyaryl siloxanes. The alkyl or aryl groups substituted on the siloxane chain (R) or at the ends of the siloxane chains can have any structure as long as the resulting silicone remains fluid at or around room temperature. Suitable R groups include hydroxy, methyl, methoxy, ethyl, ethoxy, propyl, propoxy, phenyl, methylphenyl, phenylphenyl, aryl and aryloxy. One or more R groups on the silicon atom may represent the same group or different groups, or any combination thereof. Suitable silicone compounds are polydimethylsiloxane, polydiethylsiloxane, and polymethylphenylsiloxane. Polydimethylsiloxane, which is also known as dimethicone, is suitable and readily available in many forms and grades, including for example, edible grades suitable for use in compositions for food contact usage. The polyalkylsiloxanes that can be used include, for example, polydimethylsiloxanes. These silicone compounds are available, for example, from the General Electric Company in their Viscasil® and SF 96 series, and from Dow Corning in their Dow Corning 200 series. Polyalkylaryl siloxane fluids containing one or more alkyl or alkylaryl substituents can also be used, for example, and include, but are not limited to polymethylphenylsiloxanes, poly[(dimethylsiloxane)/(methylviny-Isiloxane)], poly[(dimethylsiloxane)/(diphenylsiloxane)], poly[(dimethylsiloxane)/(phenylmethylsiloxane)], and poly[(dimethylsiloxane)/(diphenylsiloxane)/(methylvinylsiloxane)]. These siloxanes are available, for example, from the General Electric Company as SF 1075 methyl phenyl fluid or from Dow Corning as 556 Cosmetic Grade Fluid, RHODORSIL 763 from Rhne-Poulenc, SILBIONE 70641 V 30 and 70641 V 200 from Rhone-Poulenc, the silicones of the PK series from Bayer, such as PK20, the silicones of the PN and PH series from Bayer, such as PN 1000 and PH 1000, and certain oils of the SF series from General Electric, such as SF 1250, SF 1265, SF 1154 and SF 1023.

Higher molecular weight silicone derivatives, including silicone gums and resins, may be used in accordance with the present invention and include polydiorganosiloxanes with a molecular mass of between 200,000 and 5,000,000, used alone or as a mixture in a solvent chosen from volatile silicones, polydimethylsiloxane (PDMS) oils, polyphenylmethylsiloxane (PPMS) oils, isoparaffins, methylene chloride, pentane, dodecane, tridecane and tetradecane, or mixtures thereof.

The silicone derivatives can be linear or branched, and can be modified by chemical groups to provide additional properties. For example, suitable silicone derivatives also include the amino-substituted silicone derivatives, wherein R is an amine, amide or alkyl, dialkyl or trialkyl derivatized amine constituent. By substitution of one or more of the R groups with other organic or functionalized organic groups, such as vinyl, phenyl, carboxylic acid derivatives, carboxyester and quaternary ammonium derivatives, other organopolysiloxanes can be produced. Included are mixtures of these materials, for example, but not limited to: 1) mixtures formed from a polydimethylsiloxane hydroxylated at the end of the chain (Dimethiconol according to the CTFA nomenclature) and from a cyclic polydimethylsiloxane (Cyclomethicone according to the CTFA nomenclature), such as the product Q2 1401 sold by the company Dow Corning; 2) mixtures formed from a polydimethylsiloxane gum with a cyclic silicone, such as the product SF 1214 Silicone Fluid from General Electric, which is an SE 30 gum of MW 500,000 dissolved in SF 1202 Silicone Fluid (decamethylcyclopentasiloxane); 3) mixtures of two PDMS materials of different viscosities, for example a PDMS gum and a PDMS oil, such as the products SF 1236 and CF 1241 from the company General Electric. The product "SF 1236" is a mixture of an SE 30 gum defined above, with a viscosity of 20 m2/s, and of an SF 96 oil with a viscosity of $5\times10^{31\ 5}$ m2/s (15% SE 30 gum and 85% SF 96 oil). The product "CF 1241" is a mixture of an SE 30 gum (33%) and of a PDMS (67%) with a viscosity of $10^{-2}$ m2/s. The organo-modified silicones in accordance with the present invention are silicones as defined above, containing in their general structure one or more organofunctional groups directly attached to the siloxane chain or attached via a hydrocarbon-based radical. Examples include silicones containing: a) polyethyleneoxy and/or polypropyleneoxy groups, optionally containing alkyl groups, such as: the product known as dimethicone copolyol sold by the company Dow Corning under the name "DC 1248", and alkyl (C12) methicone copolyol sold by the company Dow Corning under the name "Q2 5200", the oils "SILWET" L 722, L 7500, L 77 and L 711 from the company General Electric, the mixture of dimethicone copolyol and of cyclomethicone, such as the product sold under the name "Q2-3225C" by the company Dow Corning; the product "MIRASIL DMCO" sold by Rhone-Poulenc; b) hydroxyacylamino groups, such as those described in European patent application EP-A-0,342,834, and in particular the silicone sold by the company Dow Corning under the name "Q2-8413"; c) thiol groups, such as in the silicones "X 2-8360" from Dow Corning or "GP 72A" and "GP 71" from Genesee; Union Carbide or the silicone known as "Amodimethicone" in the CTFA dictionary; d) carboxylate groups, such as the products described in European patent EP 186,507 from Chisso Corporation, which is hereby incorporated by reference; e) hydroxylated groups, such as the polyorganosiloxanes containing a hydroxyalkyl function, described in patent application FR-A-2,589,476, which is hereby incorporated by reference, and in particular polyorganosiloxanes containing a .gamma.-hydroxy-propyl function; 0 alkoxylated groups containing at least 12 carbon atoms, such as the product "Silicone Copolymer F 7551" from SWS Silicones and the products "ABILWAX 2428", "ABILWAX 2434" and "ABILWAX 2440" from the company Goldschmidt; g) acyloxyalkyl groups containing at least 12 carbon atoms, such as, for example, the polyorganosiloxanes described in patent application FR-A-2,641,185, which is hereby incorporated by reference, and in particular polyorganosiloxanes containing a stearoyloxypropyl function; h) quaternary ammonium groups, such as in the products "X2 81 08" and "X2 81 09" and the product "ABIL K 3270" from the company Goldschmidt; i) amphoteric or betaine groups, such as in the product sold by the company Goldschmidt under the name "ABIL B 9950"; and j) bisulphite groups, such as in the products sold by the company Goldschmidt under the names "ABIL S 201" and "ABIL S 255". The block copolymers having a polysiloxane-polyoxyalkylene linear block as repeating unit, which are used in the context of the present invention, include those have the following general formula: ([Y($R_2$SiO)aR'2SiYO][CnH2nO—)b])c (II) in which R and R', which may be identical or different, represent a monovalent hydrocarbon-based radical containing no aliphatic unsaturation, n is an integer ranging from 2 to 4, a is an integer greater than or equal to 5, particularly between 5 and 200 and even more particularly between 5 and 100, b is an integer greater than or equal to 4, particularly between 4 and 200 and even more particularly between 5 and 100, c is an integer greater than or equal to 4, particularly between 4 and 1000 and even more particularly between 5 and 300, Y represents a divalent organic group which is linked to the adjacent silicon atom via a carbon-silicon bond and to a polyoxyalkylene block via an oxygen atom, the average molecular weight of each siloxane block is between about 400 and about 10,000, that of each polyoxyalkylene block being between about 300 and about 10,000, the siloxane blocks represent from about 10% to about 95% of the weight of the block copolymer, the average molecular weight of the block copolymer being at least 3000 and particularly between 5000 and 1,000,000 and even more particularly between 10,000 and 200,000. R and R' are suitably chosen from the group comprising alkyl radicals such as, for example, the methyl, ethyl, propyl, butyl, pentyl, hexyl, octyl, decyl and dodecyl radicals, aryl radicals such as, for example, phenyl and naphthyl, arylalkyl radicals such as, for example, benzyl and phenethyl, and tolyl, xylyl and cyclohexyl radicals. Y is suitably selected from radicals including —R"—, —R"—CO—, —R"—NHCO—, —R"—NH—CO—NH—R"—NHCO or —R"—OCONH—R'"—NHCO—, where R" is a divalent alkylene group such as, for example, ethylene, propylene or butylene, and R'" is a divalent alkylene group or a divalent arylene group such as —C6H4, —C6H4C6H4-, C6H4-CH2-C6H4, C6H4-C(CH3)2C6H4. Even more particularly, Y represents a divalent alkylene radical, more particularly the —CH2-CH2-CH2- radical or the —C4H8- radical. The preparation of the block copolymers used in the context of the present invention is described in European application EP 0,492,657 A1, which is hereby incorporated by reference.

Also suitable are the use of one or more volatile silicone oils, that is silicone oils with sufficient vapor pressure or volatility sufficient to at least partially or completely evaporate into the atmosphere during and/or after application of the inventive compositions onto a leather surface. The inventive compositions may in one embodiment contain solely a volatile silicone fluid as the silicone oil, or in an alternative embodiment may optionally contain one or more volatile silicone fluids in combination, or in yet another embodiment may optionally contain one or more volatile and one or more non-volatile silicone fluids in combination. Volatile silicone oils generally are low viscosity silicone fluids with an appreciable vapor pressure at ambient temperatures. Generally, the volatile silicone fluids useful in the present invention have a viscosity of less than about 10 centistokes at 25 C and optionally less than about 5 centistokes at 25 C.

Suitable volatile silicone oils include the polydimethylcyclosiloxanes. Polydimethylcyclosiloxane fluids useful in the present invention can be defined by the general formula [(CH3)2 SiO]x where x has a value from three to eight. Generally, the polydimethylcyclosiloxane fluid useful in the present invention is a mixture of one or more of the various species represented by the above formula. The commercial polydimethylcyclosiloxanes are mixtures of the various species represented by the above formula and are considered within the scope of the present invention. Some suitable polydimethylcyclosiloxane fluids for use in this invention are those where octamethylcyclotetrasiloxane, decamethylcyclopentasiloxane, and dodecamethylcyclohexasiloxane (i.e. where x is from 4 to 6) predominate. The fluids where decamethylcyclopentasiloxane and dodecamethylcyclohexasi-loxane predominate are particularly suited. In accordance with another embodiment, those volatile silicone fluids manufactured by Dow Corning™ Corporation are used. It is believed that Dow Corning 245 and 345 volatile silicone fluids primarily consist of decamethylcyclopentasiloxane with lesser amounts of dodecamethylcyclohexasiloxane and minor amounts of octamethylcyclotetrasiloxane. Other suitable volatile silicones include "DC 244", "DC 245", "DC 246", "DC 344", "DC 345", and "DC 346", (manufactured by Dow Corning); SILICONE 7207 and SILICONE 7158 (manufactured by the Union Carbide Corp.); SF 1202 (manufactured by General Electric); and SWS-03314 (manufactured by SWS Silicones, Inc.).

Also suitable for use, and particularly in combination with other silicone oils, are the modified silicone derivatives described below. Examples also include, but are not limited to, polyalkyleneoxide modified polydimethylsiloxane, available from General Electric as SILWET 7650, polyalkyleneoxide modified heptamethyltrisiloxane, also available from General Electric as SILWET 7280 and SILWET 7608, silicone glycol copolymer surfactant, available from Dow Corning as DC 57 and the Dow Corning silicone polyether surfactant designated Q2-5211. Additional examples include, but not limited to, alkyl methyl siloxanes DC 56 available from Dow Corning and organomodified dimethylsiloxane available from General Electric designated as FORMASIL 433.

The silicone derivative of the cleaning composition of component b) i) can be silicone-acrylate copolymers. The silicone portion of this copolymer constitutes from about 10% to about 95%, based on the total weight of the copolymer. In another embodiment of the instant invention, the silicone portion of this copolymer constitutes from about 20% to about 65%, based on the total weight of the copolymer. In another embodiment of the instant invention, the silicone portion of this copolymer constitutes from about 20% to about 35%, based on the total weight of the copolymer. The silicone portion of the copolymer is composed of from about 88% to about 97%, preferably 92 to 97 mole percent of dimethylsiloxane units and from about 3% to about 12%, preferably from about 3% to about 8% mole percent of methylvinylsiloxane units. The remaining 5% to about 95% based on weight of the silicone-acrylate copolymer, preferably about 35% to about 80%, and more preferably about 65% to about 80% is composed of the acrylate portion. The acrylate portion is an acrylate monomer selected from the group consisting of ethyl acrylate, methyl acrylate, acrylic acid, ethyl methacrylate, methyl methacrylate, methacrylic acid, and acrylonitrile.

The silicone-acrylate copolymers employed in the instant invention may be prepared by emulsion polymerization. Suitable emulsion polymerization processes for preparing these copolymers are set forth in French Patent No. 1,491,782. Essentially, in the preferred embodiment, the process of preparing the copolymer involves the polymerization of the siloxane portion in the emulsion first, the subsequently adding thereto the appropriate acrylate monomer(s) and copolymerizing the silicone and acrylate monomers in the emulsion. Alternatively, the silicone and acrylate monomers can be emulsified together and then the silicone monomers polymerized first and then subsequently adding a catalyst and causing polymerization of the resulting siloxane and the acrylate monomers to form the desired silicone-acrylate copolymer.

Mixtures and combinations of any of the silicone derivatives of component exampled herein, for example, silicone oils having different molecular weights, different viscosities, different functionalized derivatives, different volatilities and/or vapor pressures, different properties and benefits, and combinations thereof, may advantageously be combined in the cleaning compositions of the present invention. For example, a "lighter" or lower viscosity polyorganosiloxane can be combined with a "heavier" or higher viscosity silicone oil, and/or a silicone gum and/or silicone elastomer for purposes of dispersion in the compositions of the present invention, wherein the "heavier" materials would otherwise be difficult to handle and disperse if used solely or in combinations without a "lighter" silicone included. Alternatively, a volatile silicone oil may be combined with a less volatile or essentially non-volatile silicone oil.

The silicone derivatives of component b) i) are also useful for imparting a shine or glossy coating to the treated surfaces, resulting in enhanced appearance and other aesthetic benefits associated with modification of incident light, such as refractive and diffusive contributions to specular reflections that contribute to the perception of enhanced color and tone, and decreased perception of surface defects such as scratches, stress cracks, striations, and other surface defects that commonly develop on surfaces with normal age and wear. Hence, the silicone derivatives of component b) i) are useful for their restorative effect when used on aged and worn leather surfaces.

Another embodiment of the instant invention is a mixture of a polysiloxane copolymer and an amino-substituted silicone copolymer as the components. The polysiloxane copolymer of the mixture is depicted in formula (III).

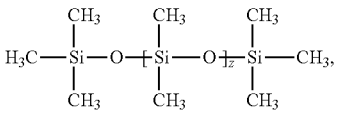

wherein z is an integer from 1 to about 5000; and the amino-substituted silicone copolymer of the mixture is depicted in formula (IV)

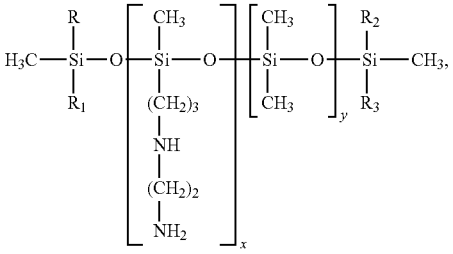

wherein

R, $R_1$, $R_2$ and $R_3$ independently from each other are $CH_3$, OH or $OC_1$-$C_4$alkyl, x is an integer from 1 to 2000, and y is an integer from 1 to 2000.

Another embodiment of the instant invention is a mixture of a polysiloxane copolymer and an amino-substituted silicone copolymer as the components of b) i). The polysiloxane copolymer of the mixture is depicted in formula (III)

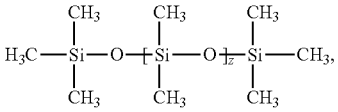

wherein z is an integer from 1 to about 2000; and the amino-substituted silicone copolymer of the mixture is depicted in formula (IV)

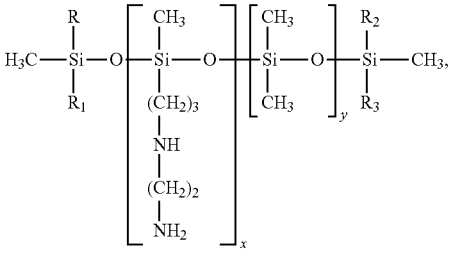

wherein

R, $R_1$, $R_2$ and $R_3$ independently from each other are $CH_3$, OH or $OC_1$-$C_4$alkyl, x is an integer from 1 to 200, and y is an integer from 1 to 500.

Another embodiment of the instant invention is a mixture of a polysiloxane copolymer and an amino-substituted silicone copolymer as the components of b) i). The polysiloxane copolymer of the mixture is depicted in formula (III)

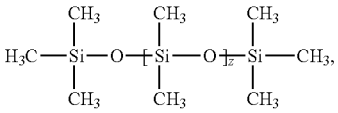

wherein z is an integer from 10 to about 500; and the amino-substituted silicone copolymer of the mixture is depicted in formula (IV)

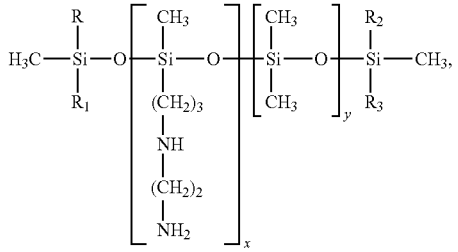

wherein

R, $R_1$, $R_2$ and $R_3$ independently from each other are $CH_3$, OH or $OC_1$-$C_4$alkyl, x is an integer from 1 to 100, and y is an integer from 10 to 300.

Another embodiment of the instant invention is a mixture of a polysiloxane copolymer and an amino-substituted silicone copolymer as the components of b) i), wherein the amino-substituted silicone copolymer of the mixture is depicted in formula (IV)

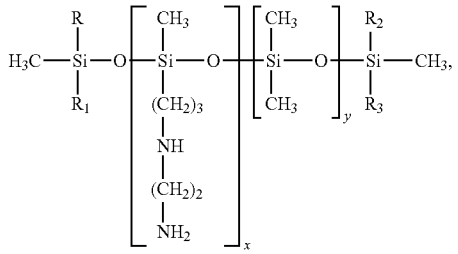

wherein

R, $R_1$, $R_2$ and $R_3$ are $CH_3$, and x and y are integers as depicted above.

Another embodiment of the instant invention is a molecular weight for the compound of formula (III) is from about 200 to about 200,000 Daltons. Another embodiment of the instant invention is a molecular weight of the compound of formula (III) is from about 500 to about 150,000 Daltons. Another embodiment of the instant invention is a molecular weight of the compound of formula (III) is from about 1000 to about 100,000 Daltons.

Another embodiment of the instant invention is a molecular weight of the compound of formula (IV) is from about 200 to about 200,000 Daltons. Another embodiment of the instant invention is a molecular weight of the compound of formula (IV) is from about 500 to about 150,000 Daltons. Another embodiment of the instant invention is a molecular weight of the compound of formula (IV) is from about 1000 to about 100,000 Daltons.

In suitable embodiments, the silicone/component or derivative comprises 0.001% by weight to about 25% by weight, or 0.01% by weight to about 20% by weight, or alternatively 0.05% by weight to about 18% by weight of the inventive composition, or alternatively 0.1% by weight to about 15% by weight of the inventive composition.

Water

Optionally, compositions according to the present invention may contain water. It should be appreciated that the water may be provided as deionized water or as softened water. The water provided as part of the concentrate can be relatively free of hardness. It is expected that the water can be deionized to remove a portion of the dissolved solids. That is, the concentrate can be formulated with water that includes dissolved solids, and can be formulated with water that can be characterized as hard water.

Water, when present in the leather article treating/cleaning compositions of the present invention, preferably comprises from about 0.001% to about 5%, more preferably from about 0.005% to about 5%, even more preferably from about 0.01% to about 1% by weight of the leather article treating composition.

Water, when present in the consumable leather article treating/cleaning compositions of the present invention, preferably comprises from about 0% to about 99%, more preferably from about 40% to about 95%, even more preferably from about 50% to about 90% by weight of the consumable leather article treating/cleaning composition.

Water, if any, may be added separately to the leather article treating apparatus to form the leather article treating composition rather than being present in the consumable leather article treating composition.

Preservative

The inventive protectant composition may optionally include one or more preservatives and/or biocides. Many different types of preservatives and/or biocides can be used in the protectant composition. Furthermore, one or more preservatives and/or biocides can be used in the protectant composition. Non-limiting of examples of preservatives that can be used in the protectant composition include, but are not limited to, mildewstat or bacteriostat, methyl, ethyl and propyl parabens, short chain organic acids (e.g. acetic, lactic and/or glycolic acids), bisguanidine compounds (e.g., Dantogard and/or Glydant) and/or short chain alcohols (e.g. ethanol and/or IPA). Non-limiting examples of mildewstat or bacteriostat include, but are not limited to, mildewstats (including non-isothiazolinones compounds) including Proxel GXL and Vantocil IB, from Avecia Corporation, Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, and Neolone M-10, all available from Rohm and Haas Company; BRONOPOL, a 2-bromo-2-nitropropane 1, 3 diol, from Boots Company Ltd., PROXEL CRL, a propyl-p-hydroxybenzoate, from ICI PLC; NIPASOL M, an o-phenyl-phenol, sodium salt, from Nipa Laboratories Ltd., DOWICIDE A, a 1,2-Benzoisothiazolin-3-one, Dowacil 75, and Bioban, all from Dow Chemical Co., and IRGASAN DP 200, a 2,4,4'-trichloro-2-hydroxydiphenylether, from Ciba-Geigy A. G, and Surcide P from Surety Laboratories, Dantogard Plus (e.g., 1,3-Bis(hydroxymethyl)-5,5-dimethylhydantoin and hydroxymethyl-5,5-dimethylhydantoin) commercially available from Lonza, Bioban DXN (e.g., dimethoxane) commercially available from Angus, etc. Non-limiting examples of biocides include quaternary ammonium compounds and phenolics. Non-limiting examples of these quaternary compounds include benzalkonium chlorides and/or substituted benzalkonium chlorides, di($C_6$-$C_{14}$)alkyl di short chain ($C_{1-4}$ alkyl and/or hydroxyalkl) quaternary ammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethylbenzylammonium chlorides, and mixtures thereof, wherein the alkyl radicals may be C1 to C24. Biguanide antimicrobial actives include, but not limited to, polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class. When one or more preservatives and/or biocides are included in the protectant composition, the amount of preservative and/or biocide is at least about 0.001 weight percent and less than about 1 weight percent, typically about 0.04-0.8 weight percent, more typically about 0.04-0.6 weight percent, still more typically about 0.05-0.5 weight percent, and yet even more typically about 0.05-0.3 weight percent.

Surfactant/Emulsifier Blend

The invention includes a blend of surfactants/emulsifiers that act in a synergistic manner to protect the delicate leather surface while also providing cleaning. The surfactant blend includes a non-ionic surfactant such as an alcohol alkxoylate. A preferable alcohol ethoxylate is a C10 to 1C12 alcohol with 6 moles of ethoxylate. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof.

The Surfactant/Emulsifier blend also includes an amphoteric surfactant. Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J. A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch), which is herein incorporated by reference in its entirety. A preferred amphoteric surfactant is cocamidopropylbetaine.

The third component in the surfactant emulsifier blend is a sorbitan ester, (also known as SPANs), particularly sorbitan monostearate; sorbitols; polysorbates (polyoxyethylene sorbitan esters, also known in industry as TWEENs), particularly polysorbate 20, polysorbate 60, polysorbate 65, and polysorbate 80; stearoly lacrylates; lecithin and derivatives; polyglycol fatty acid esters; p-Cymene; quaternary ammonium compounds; sodium alkyl sulfonates; triethanolamine; and alkyl polysaccharides. In a preferred embodiment, the polysorbate 20 (polyoxyethylene sorbitan monooleate).

The surfactant blend includes from about 4% to about 20%, of the entire composition based on weight of the cleaning composition, preferably about 6% to about 18% and more preferably about 8% to about 15%. The ratio of the sorbitan ester, coconut derivative, and alcohol ethoxylate can comprise a ratio of 2:1:1 to about 1:1:1.

Hydrotope/Solubilizer

The composition includes a hydrotope/solubilizer. This is typically an amine compound. Specific examples of the amine compounds useful for the invention can include monoethanolamine, diethanolamine, triethanolamine, N-methylethanolamine, N,N-dimethylethanolamine, N-ethylethanolamine, N,N-diethylethanolamine, N-isopropylethanolamine, N,N-diisopropylethanolamine, monoisopropanolamine, diisopropanolamine, triisopropanolamine, N-methylisopropanolamine, N,N-dimethylisopropanolamine, N-ethylisopropanolamine, N,N-diethylisopropanolamine, N-isopropylisopropanolamine, N,N-diisopropylisopropanolamine, mono-n-propanolamine, di-n-propanolamine, tri-n-propanolamine, N-methyl-n-propanolamine, N,N-dimethyl-n-propanolamine, N-ethyl-n-propanolamine, N,N-diethyl-n-propanolamine, N-isopropyl-n-propanolamine, N,N-diisopropyl-n-propanolamine, monobutanolamine, dibutanolamine, tributanolamine, N-methylbutanolamine, N,N-dimethylbutanolamine, N-ethylbutanolamine, N,N-diethylbutanolamine, N-isopropylbutanolamine and N,N-diisopropylbutanolamine. Other examples of useful hydrotope/solubilizers include compounds such as Sodium Xylene Sulfonate or Propylene Glycol The hydrotope/solubilizer is present in an amount from about 0.001% to about 0.10% preferably from about 0.005% to about 0.08% and more preferably from about 0.01% to a about 0.05% by weight of the composition.

Thickening Agent

The cleaning/treatment composition includes a thickener. The viscosity of the cleaning composition increases with the amount of thickening agent, and viscous compositions are useful for uses where the cleaning composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.1 wt. % to about 3 wt. %, from about 0.1 wt. % to about 2 wt. %, or about 0.1 wt. % to about 0.5 wt. %.

Additional Functional Materials

The cleaning/treatment compositions can include additional components or agents, such as additional functional materials. As such, in some embodiments, the cleaning/treatment composition may provide a large amount, or even all of the total weight of the cleaning composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use. The cleaning/treatment preparations may optionally contain other soil-digesting components, additional surfactants, disinfectants, sanitizers, acidulants, complexing agents, corrosion inhibitors, dyes, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning applications, but it should be understood that other embodiments may include functional materials for use in other applications.

Additional Surfactants

The cleaning/treatment composition can contain an additional anionic surfactant component that includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, can include the additional anionic surfactant component in an amount sufficient to provide a use composition having desired wetting and detersive properties after dilution with water. The concentrate can contain about 0.1 wt. % to about 0.5 wt. %, about 0.1 wt. % to about 1.0 wt. %, about 1.0 wt. % to about 5 wt. %, about 5 wt. % to about 10 wt. %, about 10 wt. % to about 20 wt. %, 30 wt. %, about 0.5 wt. % to about 25 wt. %, and about 1 wt. % to about 15 wt. %, and similar intermediate concentrations of the anionic surfactant.

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent/treatment composition.

Nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Additional nonionic surfactants include alcohol alkoxylates. A suitable alcohol alkoxylate including linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the composition, they can be included in an amount of at least about 0.1 wt. % and can be included in an amount of up to about 15 wt. %. The concentrate can include about 0.1 to 1.0 wt. %, about 0.5 wt. % to about 12 wt. % or about 2 wt. % to about 10 wt. % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

When the detergent composition includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The cleaning/treatment composition can contain a cationic co-surfactant component that includes a detersive amount of cationic surfactant or a mixture of cationic surfactants. Cationic co-surfactants that can be used in the cleaning composition include, but are not limited to: amines such as primary, secondary and tertiary monoamines with C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Detergent Fillers

The cleaning composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_1$-$C_{10}$ alkylene glycols such as propylene glycol, and the like. When the concentrate includes a detergent filler, it can be included in an amount of between about 1 wt % and about 20 wt % and between about 3 wt % and about 15 wt %.

Defoaming Agents

The cleaning composition can include a defoaming agent to reduce the stability of foam and reduce foaming. When the concentrate includes a defoaming agent, the defoaming agent can be provided in an amount of between about 0.01 wt. % and about 3 wt. %.

Examples of defoaming agents that can be used in the composition includes ethylene oxide/propylene oxide block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein for all purposes.

Antiredeposition Agents

The cleaning composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. When the concentrate includes an anti-redeposition agent, the anti-redeposition agent can be included in an amount of between about 0.5 wt % and about 10 wt % and between about 1 wt % and about 5 wt %.

Stabilizing Agents

Stabilizing agents that can be used in the cleaning composition include, but are not limited to: primary aliphatic amines, betaines, borate, calcium ions, sodium citrate, citric acid, sodium formate, glycerine, malonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to about 20 wt %, between about 0.5 wt. % to about 15 wt. % and between about 2 wt. % to about 10 wt. %.

Hydrotropes

The compositions of the invention may optionally include a hydrotrope that aides in compositional stability and aqueous formulation. Functionally speaking, the suitable hydrotrope couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents for use in the present invention include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or- terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides. A preferred hydrotope is sodium xylenesulfonate (SXS).

The composition of an optional hydrotrope can be present in the range of from about 0 to about 25 percent by weight.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Adjuvants

The present composition can also include any number of adjuvants. Specifically, the cleaning composition can include stabilizing agents, wetting agents, thickeners, foaming agents, corrosion inhibitors, biocides, hydrogen peroxide, pigments or dyes among any number of other constituents which can be added to the composition. Such adjuvants can be pre-formulated with the present composition or added to the system simultaneously, or even after, the addition of the present composition. The cleaning composition can also contain any number of other constituents as necessitated by the application, which are known and which can facilitate the activity of the present compositions.

Embodiments of the Present Compositions

The cleaning composition of the present invention is effective at removing soils containing proteins, lard and oils. In one embodiment, the cleaning composition is effective at removing soils containing up to about 20% protein. Several suitable exemplary liquid concentrate compositions are provided in the following tables.

TABLE 1

| Exemplary Composition | | | |
|---|---|---|---|
| Component | First Range (Wt %) | Second Range (Wt %) | Third Range (Wt %) |
| Water | 0.1-99 | 40-95 | 50-90 |
| Amine dispersant | 0.001-0.15 | 0.005-0.1 | 0.01-0.08 |
| Alcohol alkoxylate | .01-10 | .10-8 | 1-7 |
| silicone | 0.1-25 | 0.5-20 | 1-15 |
| preservative | 0.04-0.8 | 0.04-0.6 | 0.05-0.5 |
| Coconut derived surfactant | .01-10 | .10-8 | 1-7 |
| Sorbitan ester | .1-20 | .5-15 | 1-12 |
| thickener | 0.1-3 | 0.1-2 | 0.1-0.5 |

In the case of a RTU composition, it should be noted that the above-disclosed cleaning composition may, if desired, be further diluted with up to about 96 wt. % water, based on the weight of the cleaning composition.

Method of Use

The protectant composition of the present invention has a number of applications such as, but not limited to, automotive care applications, home care applications, personal care applications, industrial and institutional applications, pharmaceutical applications, textile applications, and the like. The protectant composition can be used for treating a host of inanimate surfaces including, but not limited to, hard and soft surfaces found throughout the interior and exterior of the household and automotive areas. Household surfaces on which the protectant composition can be used include, but are not limited to, floors, counter tops, furniture, walls and surfaces constructed of glass, plastic, fiberglass, laminates, such as Formica™ and Corian™, tile, porcelain, brick, concrete, limestone, grout, marble, granite as well as metallic surfaces such as aluminum, steel, stainless steel, iron, chrome, copper, brass and the like. Other household surfaces include carpet, upholstery, vinyl, leather, textiles, fabric, floors, walls, ceilings and wall finishes, such as wall paper, painted surfaces and panels. Automotive surfaces on which the protectant composition may be used include tires, rubber, vinyl, fabric, plastic and general elastomer surfaces found on the exterior and interior of a boat, vehicle, automobile, bus, car, plane, motorcycle and the like.

Method of Application

The protectant composition of the present invention may be applied to the target surface by a variety of means, including direct application by means of a spray, pump or aerosol dispensing means, or by other means, including the use of a carrier, or dilution system, as for example, but not limited to a wash, dip or immersion process. Regarding applications by use of a carrier, such suitable carriers include, for example, an impregnated wipe, foam, sponge, cloth, towel, tissue or paper towel or similar releasably absorbent carrier that enables the inventive compositions to be applied by direct physical contact and transferred from the carrier to the target surface, generally during a spreading, padding, rubbing or wiping operation. Combinations of a direct application, followed by a spreading, padding, rubbing or wiping operation performed with the aid of a foam, sponge, cloth, towel, tissue or paper towel, squeegee or similar wiping implement is also suitable for applying the protectant compositions of the present invention.

The protectant composition may be also be sprayed directly onto the target surface and therefore are typically packaged in a spray dispenser. The spray dispenser can be any of the manually activated means for producing a spray of liquid droplets as is known in the art, e.g., trigger-type, pump-type, electrical spray, hydraulic nozzle, sonic nebulizer, high pressure fog nozzle, non-aerosol self-pressurized, and aerosol-type spray means. Automatic activated means can also be used herein. These types of automatic means are similar to manually activated means with the exception that the propellant is replaced by a compressor. The spray dispenser can be an aerosol dispenser. Said aerosol dispenser comprises a container which can be constructed of any of the conventional materials employed in fabricating aerosol containers. A more complete description of commercially available aerosol-spray dispensers appears in U.S. Pat. Nos. 3,436,772 and 3,600,325, both of which are fully incorporated herein by reference. Alternatively, the spray dispenser can be a self-pressurized non-aerosol container having a convoluted liner and an elastomeric sleeve. A more complete description of self-pressurized spray dispensers can be found in U.S. Pat. Nos. 4,260,110; 5,111,971 and 5,232,126, both of which are fully incorporated herein by reference. The container and the pump mechanism can be constructed of any conventional material employed in fabricating pump-spray dispensers, including, but not limited to: polyethylene; polypropylene; polyethyleneterephthalate; blends of polyethylene, vinyl acetate, and rubber elastomer. Other materials can include stainless steel. A more complete disclosure of commercially available dispensing devices appears in: U.S. Pat. Nos. 4,082,223; 4,161,288; 4,274,560; 4,434,917; 4,735,347; 4,819,835; 4,895,279; and 5,303,867; all of which are fully incorporated herein by reference.

Forming a Composition of the Invention

A mixing system provides for continuous mixing of the ingredients at high shear to form a substantially homogeneous liquid or semi-solid mixture in which the ingredients are distributed throughout its mass. The mixing system includes means for mixing the ingredients to provide shear effective for maintaining the mixture at a flowable consistency, with a viscosity during processing of about 1,000-1,000,000 cP, preferably about 50,000-200,000 cP. The mixing system can be a continuous flow mixer or a single or twin screw extruder apparatus.

The mixture can be processed at a temperature to maintain the physical and chemical stability of the ingredients, such as at ambient temperatures of about 20-80° C., and about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the scale control component may be separate from the remainder of the warewash detergent. One or more premixes may be added to the mixture.

The ingredients are mixed to form a substantially homogeneous consistency wherein the ingredients are distributed substantially evenly throughout the mass.

The concentrate can be provided in the form of a liquid. Various liquid forms include gels and pastes. Of course, when the concentrate is provided in the form of a liquid, it is not necessary to harden the composition to form a solid. In fact, it is expected that the amount of water in the composition will be sufficient to preclude solidification. In addition, dispersants and other components can be incorporated into the concentrate in order to maintain a desired distribution of components.

The packaging receptacle or container may be rigid or flexible, and composed of any material suitable for containing the compositions produced according to the invention, as for example glass, metal, plastic film or sheet, cardboard, cardboard composites, paper, and the like. The composition is processed at around 150-170° F. and are generally cooled to 100-150° before packaging. so that processed mixture may be cast or extruded directly into the container or other packaging system without structurally damaging the material. As a result, a wider variety of materials may be used to manufacture the container than those used for compositions that processed and dispensed under molten conditions.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will erode a surface of the concentrate to provide a liquid concentrate that will be introduced into the dishwashing machine.

Steps for Forming a Stable Emulsion

The silicone formulation can separate into two phases rather quickly. In order to ensure consistent and correct proportions of the two phases of the initial formulation, a thickening agent to suspend the oil droplets in water.

Once the formulation included Xanthan Gum for droplet suspension the process needed further definition, with two criteria need to be satisfied:

1) the thickener (such as Xanthan Gum) must be fully hydrated before combining with poly dimethylsiloxane, and
2) the Polydimethylsiloxane must be blended with surfactants, any fragrance, and any buffering agent before combining with water.

Two premixes are required to achieve both process definition criteria. The Xanthan Gum premix was made in the main mix tank while a premix tank was used for the Silicone premix. This arrangement was chosen to match existing mixing equipment. Although the Silicone premix was mixed until uniform it separated into two phases over time. Stability of the silicone premix is desired to ensure uniform emulsion when combined with water.

Generally, macro emulsions are thermodynamically unstable and surfactants can be used, stoichiometrically, to stabilize by reducing surface tension. However, the quantities of surfactants used in this formulation are in excess of the stoichiometric quantities, for the purpose of providing additional detergency in for the end use.

We achieved stable PDMS+surfactant premix by emulsifying a bit of water inside. This made the water in oil emulsion the most stable finished product. Then, the amount of water was reduced to 30% of inversion point and a stable water-in-oil premix, and a stable final product was achieved. The resultant emulsion is stable without high shear and the oil droplets generally do not coalesce. This process also allows for the creation of a stable emulsion without the stoichiometric ratio of surfactants and silicone.

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Example 1

Cleanability of booth surfaces in Quick Service Restaurants (QSR) is becoming increasingly challenging as new décor types are being implemented globally into store remodels and new builds.

Booth surface cleanliness is the most prevalent décor concern across chains and global locations. Where previous booth surfaces were historically all hard vinyl, the new decors are moving towards higher end materials including leather, soft vinyl, and upholstery fabric. These softer decors are more apt for soil staining due to their heavier textured surfaces and their softer design, creating a harboring site for soils that cannot be reached by the current cleaning solutions and procedures. Black soot soiling of deeply imprinted soft vinyl décor and upholstery fabrics offers the largest cleaning challenge.

This invention involves the development of a cleaning product for these purposes.

First Prototypes:

| RM | | SC-1 | SC-2 | SC-3 | SC-4 | SC-5 | SC-6 | SC-7 |
|---|---|---|---|---|---|---|---|---|
| 290287 | ADC Silicone 200FL | 11.778 | 13.043 | 3 | 10.586 | 5.418 | 8.751 | 10.75 |
| 116178 | Triethanolamine 99% DRM | 0.04 | 0.028 | 0.05 | 0.046 | 0.04 | 0.027 | 0.027 |
| 172033 | Etxltd Prmy Lnr Alc C10-C12 6 Mol EO | 3.043 | 8 | 8 | 8 | 8 | 4.913 | 5.346 |
| 170767 | Mixture of alcohol ethoxylate and alkylgluc | 2.00 | 8.00 | 7.38 | 3.66 | 3.20 | 4.17 | 8.00 |
| 230174 | Custopoly GL | 0.75 | 0.50 | | | 0.25 | | 0.25 |
| 830845 | Xantan Gum | | | 0.50 | 0.70 | | 0.25 | |
| 100016 | Water Zeolite Softened TNK | 82.988 | 70.78 | 81.426 | 77.561 | 83.196 | 81.993 | 75.727 |
| 300148 | 2-Methyl-4-isothiazolin-3-one DRM | 0.15 | 0.15 | 0.15 | 0.15 | 0.15 | 0.15 | 0.15 |

| RM | | SC-8 | SC-9 | SC-10 | SC-11 | SC-12 | SC-13 |
|---|---|---|---|---|---|---|---|
| 290287 | ADC Silicone 200FL | 7.891 | 3 | 7.002 | 3 | 3 | 3 |
| 116178 | Triethanolamine 99% DRM | 0.05 | 0.033 | 0.05 | 0.05 | 0.034 | 0.027 |
| 172033 | Etxltd Prmy Lnr Alc C10-C12 6 Mol EO | 2.96 | 8 | 3.002 | 4.741 | 2 | 4.388 |
| 170767 | Mixture of alcohol ethoxylate and alkylgluc | 8.00 | 2.00 | 3.41 | 2.00 | 4.61 | 8.00 |
| 230174 | Custopoly GL | | 0.25 | | 0.25 | 0.25 | |
| 830845 | Xantan Gum | 0.25 | | 0.25 | | | 0.25 |
| 100016 | Water Zeolite Softened TNK | 80.949 | 86.817 | 86.385 | 90.059 | 90.207 | 84.435 |
| 300148 | 2-Metyl-4-isothiazolin-3-one DRM | 0.15 | 0.15 | 0.15 | 0.15 | 0.15 | 0.15 |

Formulations SC-2, SC-3, SC-5, SC-7, SC-9, SC-11, and SC-12 where unstable and discarded as options. Formulations SC-1, SC-4, SC-6, SC-8, SC-10 and SC-13 where potential formulations but did not meet formulation requirements of a global composition.

Thickener Formulations:

| RM | | SC-3 | SC-3B | SC-5 | SC-5B | SC-6 | SC-6B | SC-8 | SC-8B |
|---|---|---|---|---|---|---|---|---|---|
| 290287 | ADC Silicone 200FL | 3 | 3 | 5.418 | 5.418 | 8.751 | 8.751 | 7.891 | 7.891 |
| 116178 | Triethanolamine 99% DRM | 0.05 | 0.05 | 0.04 | 0.04 | 0.027 | 0.027 | 0.05 | 0.05 |
| 172033 | Etxltd Prmy Lnr Alc C10-C12 6 Mol EO | 8 | 8 | 8 | 8 | 4.913 | 4.913 | 2.96 | 2.96 |
| 170767 | Mixture of alcohol ethoxylate and alkylgluc | 7.38 | 7.38 | 3.20 | 3.20 | 4.17 | 4.17 | 8.00 | 8.00 |
| 230174 | Custopoly GL | | | 0.25 | | | | | |
| 830845 | Xantan Gum | 0.50 | | | | 0.25 | 0.25 | 0.25 | 0.25 |
| 100016 | Water Zeolite Softened TNK | 80.925 | 81.425 | 82.947 | 83.197 | 81.743 | 81.743 | 80.699 | 80.699 |
| 300148 | 2-Methyl-4-isothiazolin-3-one DRM | 0.15 | 0.15 | 0.15 | 0.15 | 0.15 | 0.15 | 0.15 | 0.15 |

The above formulations where the first ones developed to test the thickener properties: Custopoly GL didn't work with the compositions as well as Xanthan Gum.

Optimized Formulations:

| RM | | SC-14 | SC-15 | SC-16 | SC-17 |
|---|---|---|---|---|---|
| 290287 | ADC Silicone 200FL | 3 | 5.418 | 13.6 | 8.751 |
| 116178 | Triethanolamine 99% DRM | 0.05 | 0.04 | 0.04 | 0.027 |

-continued

| RM | | SC-14 | SC-15 | SC-16 | SC-17 |
|---|---|---|---|---|---|
| 170575 | C10-12 synthetic alcohols and 3 moles ethylene | 4 | 6 | 2 | 3 |
| 172452 | Lauryl Dimethylamine Oxide 30% DRM | 7.38 | 3.20 | 3.20 | 4.17 |
| 177035 | Cocamidopropylbetaine | 4.00 | 2.00 | 6.00 | 3.00 |
| 830845 | Xantan Gum | | | | |

-continued

| RM | | SC-14 | SC-15 | SC-16 | SC-17 |
|---|---|---|---|---|---|
| 100016 | Water Zeolite Softened TNK | 81.425 | 83.197 | 75.015 | 80.906 |
| 300148 | 2-Methyl-4-isothiazoline-3-one DRM | 0.15 | 0.15 | 0.15 | 0.15 |

Formulations SC-14 to SC-17 where developed Better Emulsification and No PPE Formulations:

| RM | | high ranges SC-18 | mid ranges SC-19 | low ranges SC-20 |
|---|---|---|---|---|
| 290287 | ADC Silicone 200FL | 10.5 | 5.42 | 2.5 |
| 116178 | Triethanolamine 99% DRM | 0.04 | 0.04 | 0.04 |
| 170270 | C10-12 synthetic alcohols and 3 moles ethylene | 6 | 3.20 | 1.5 |
| 172452 | Lauryl Dimethylamine Oxide 30% DRM | 3.20 | 3.20 | 3.2 |
| 177035 | Cocamidopropylbetaine | 2.00 | 2.00 | 1.5 |
| 170654 | Polyoxyethylene (20) Sorbitan Monooleate | 8.00 | 6.70 | 3.5 |
| 100016 | Water Zeolite Softened TNK | 70.115 | 79.292 | 87.61 |
| 300148 | 2-Methyl-4-isothiazolin-3-one DRM | 0.15 | 0.15 | 0.15 |

By adding raw material 170654 Polyoxyethylene Sorbitan Monooleate the formulation has better emulsification. The above formulations do not require Personal Protective Equipment. Later on the formulation process the addition of a thickener was revisited and Xanthan Gum was chosen.

Final Formulation:

With any remaining being water, fragrance, or other additional components:

| | | | |
|---|---|---|---|
| 230115 | 20 | Xanthan Gum | 0.37 |
| 177056 | 30 | Cocamidopropylbetaine | 2 |
| 300148 | 40 | 2-Methyl-4-isothiazolin-3-one DRM | 0.15 |
| 290287 | 50 | ADC Silicone 200FL | 8.62 |
| 170654 | 60 | Polyoxyethylene (20) Sorbitan Monooleate | 6.7 |
| 170270 | 70 | C10-12 synthetic alcohols and 3 moles ethylene | 3.2 |
| 116178 | 80 | Triethanolamine 99% DRM | 0.04 |

Prototypes Lab Bench Performance Testing on Soils

Soil was applied to substrate and left to dry over a 24 hr period. The soils used are those present in the QSR environment such as ketchup, mustard, red food soil and black food soil. The last two mentioned as standard soils made by Ecolab.

After soil was left to dry on surface the area to be tested was wiped with prototype solution and observations noted.

Microscopic pictures were taken before, during and after cleaning

Performance was analyzed based on how the pictures looked.

Pictures and conclusions are discussed in attachment named Leather Cleaner

Red Food Soil

Lard 3

Corn Oil, 100%

Whole dry egg

Iron III Oxide, powder

Black Food Soil

Low Odor Mineral Spirits

Mineral Oil

Motor Oil: 10/30W (SM rating)

Oil Dag (Graphite Lube)

Black Charm Ball Clay

Procedure

Substrate and Soil Identification:

1. Booth substrates were obtained from the Ecolab QSR Request for Technical Information (RTI) project archive. Surface types include:
   i. Leather
   ii. Soft vinyl, little to no imprinting
   iii. Soft vinyl, heavy imprinting (leather look)
   iv. Hard vinyl
   v. Fabric upholstery
2. Representative soils were obtained that could present potential cleaning challenges in a QSR front of house environment
   i. Ketchup
   ii. Mustard
   iii. Soda
   iv. Grease/Shortening
   v. Shoe Markings
   vi. Dirt soil (Gardner Abrasion SOP formula)
   vii. Food soil (Gardner Abrasion SOP formula)
3. Substrates were soiled and cleaned
   i. Soils applied in a horizontal pattern across the width of the substrate
   ii. Soils were allowed to air dry and age for 24 hours
   iii. Cleaners were sprayed onto a paper towel and then used to clean across the soils for the best possible clean. Products were not reapplied.

Results and Discussion

The substrate samples were soiled and cleaned via the protocol outlined above.

FIG. 1 shows the initial performance screening. Leather pieces were soiled and then cleaned with different Leather and Vinyl Cleaner Prototypes. Microscopic photos were taken before soiling, soiled and after cleaning. Those pictures marked with a star were the best performers. The pictures shown here are for black soil only.

Figure 2A:
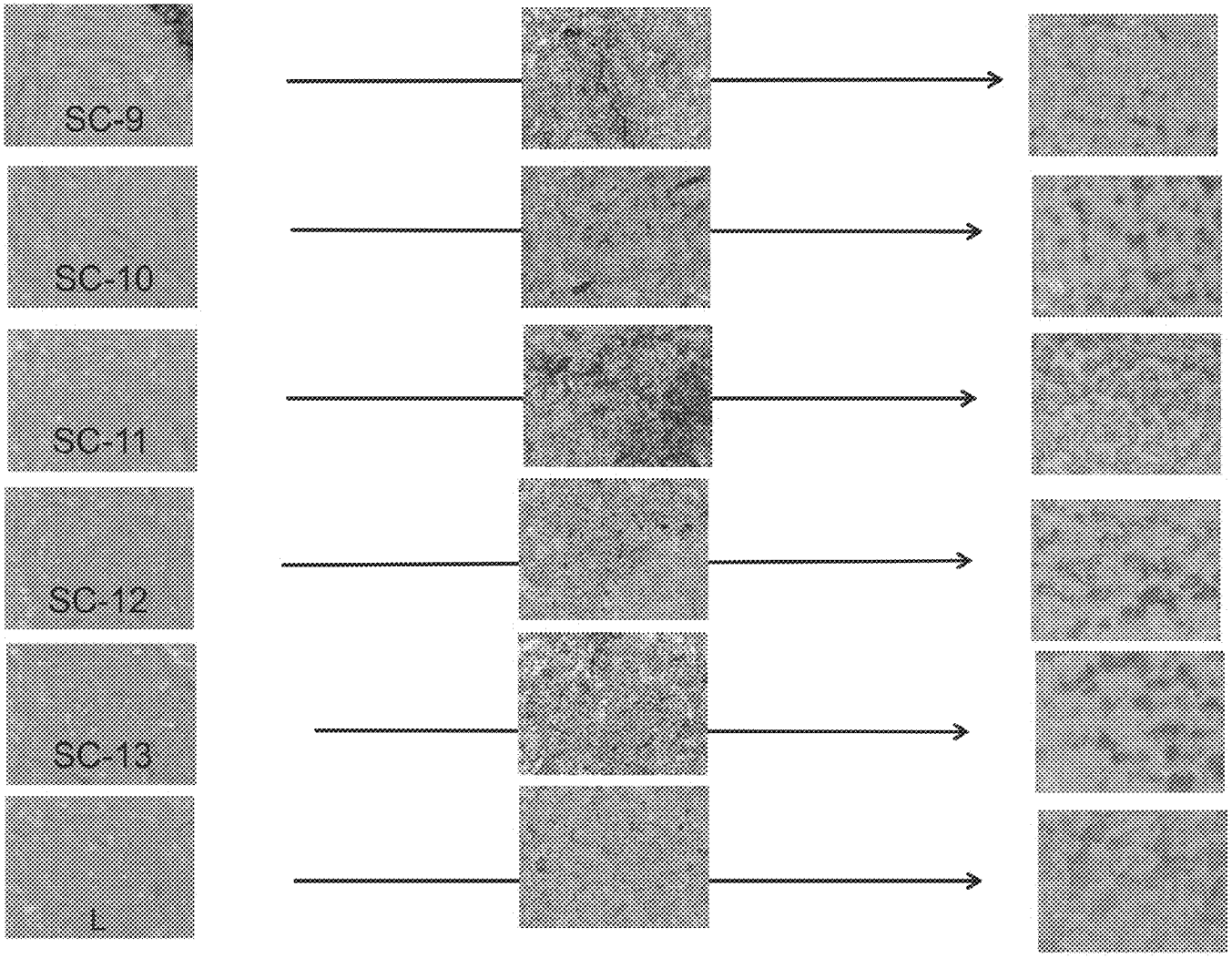
FIGS. 2A and 2B are individual photographs showing the cleaning performance of several different test formulations. Formulas SC-3, SC-5, SC-6 and SC-7 where shown to have satisfactory cleaning.
Figure 2B:
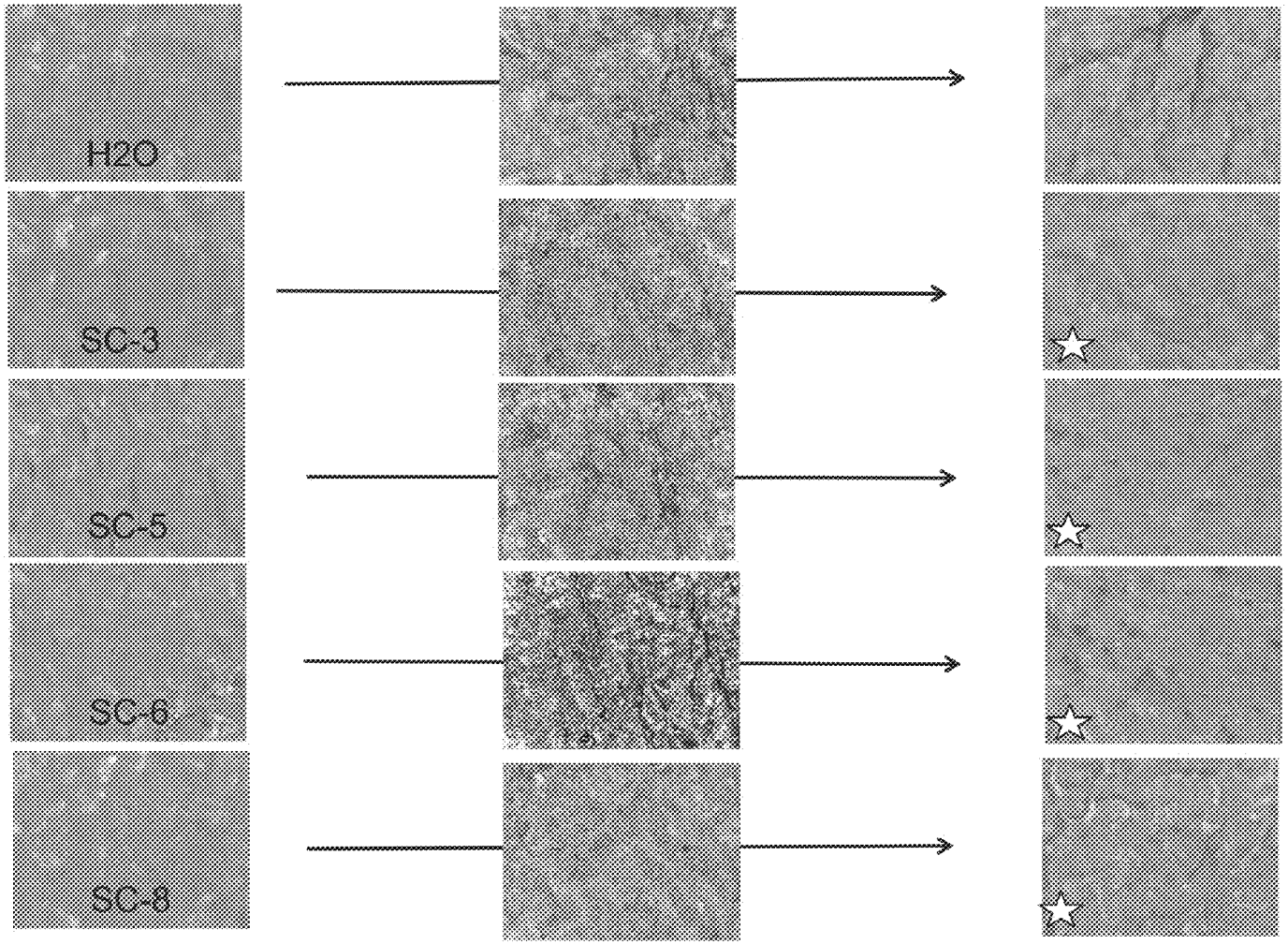

FIGS. 2A and 2B shows the cleaning performance of different formulations. Formulas SC-3, SC-5, SC-6 and SC-7 where shown to have satisfactory cleaning.

Figure 3:
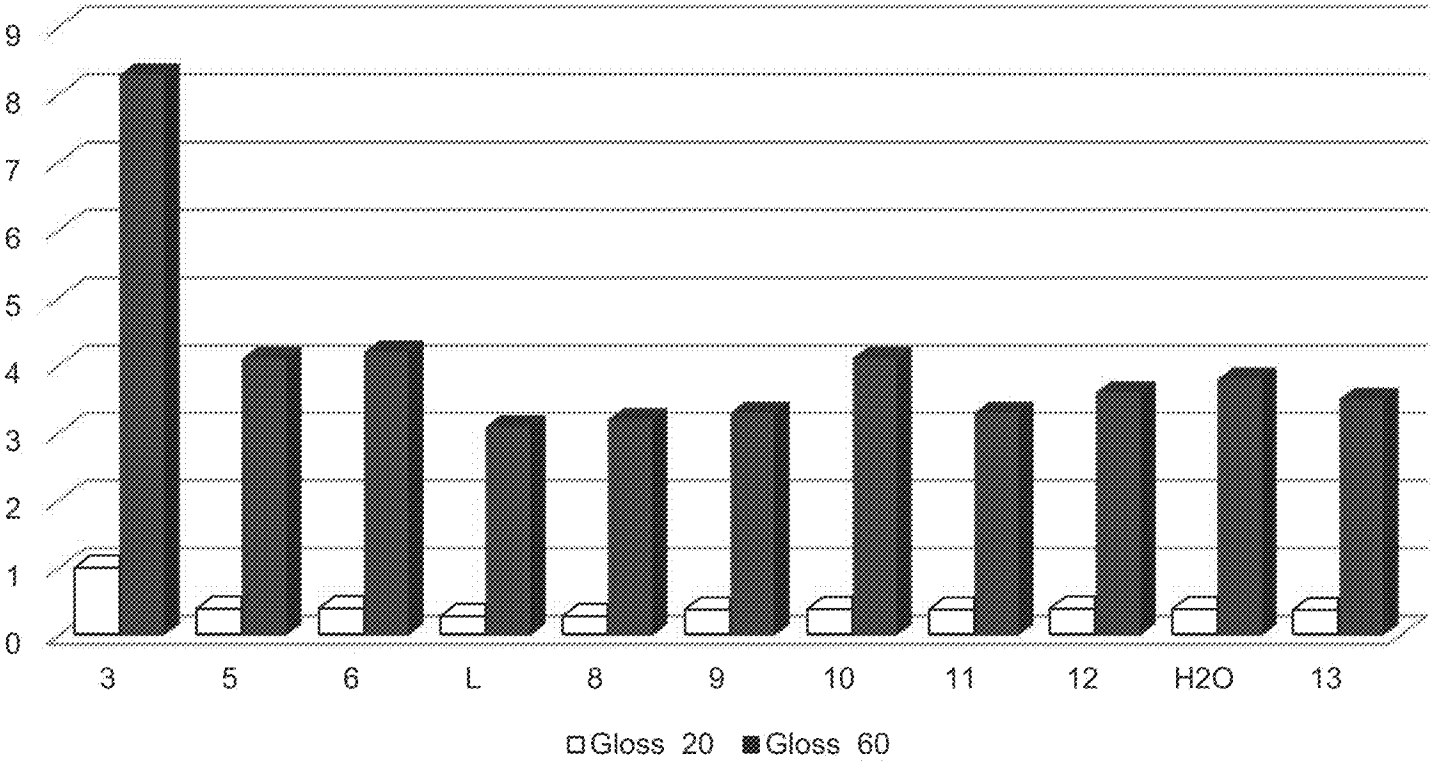
FIG. 3 is a graph showing the gloss performances of formulas SC-3, SC-5, SC-6, SC-L, SC-8, SC-9, SC-10 SC-1, SC-12, $H_2O$ and SC-13.

FIG. 3 is a graph showing the gloss performances of formulas SC-3, SC-5, SC-6, SC-L, SC-8, SC-9, SC-10 SC-1, SC-12, $H_2O$ and SC-13.

Figure 4:
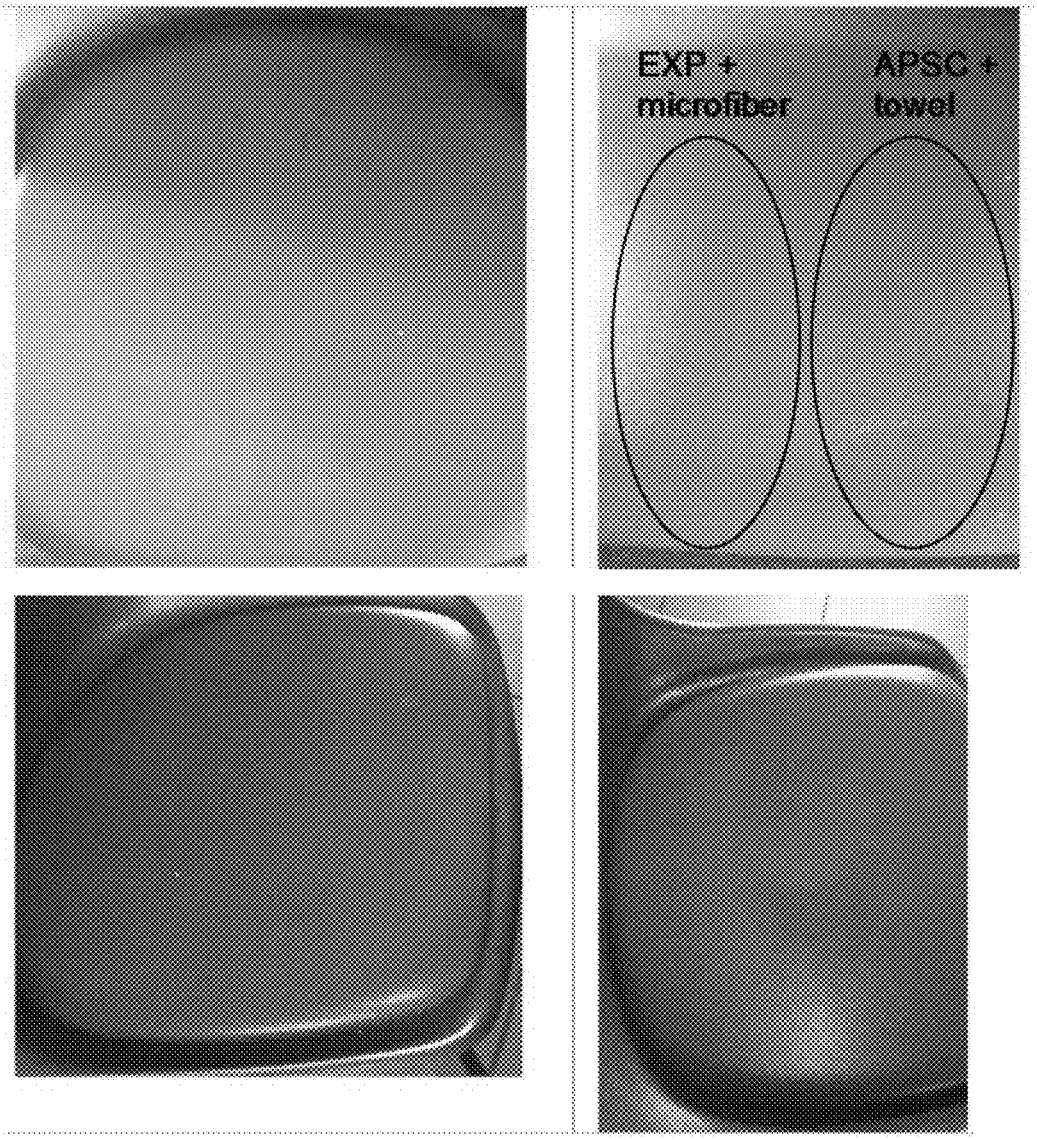
FIG. 4 includes several photographs showing the results of Field testing of the various cleansers before and after cleaning.

FIG. 4 shows the results of field testing of the various cleansers. An average of 5 measurements were taken for each reading. A composition of the invention and microfiber removed 100% of the surface soils and 80% of imbedded soils, and left the surface clean. APSC (a commercially available multi-purpose surface cleaner without any moisturizers or surfactants) and a food service towel removed nearly all surface soils but only around 30% of the imbedded soils and left soil on the surface in the form of tiny beads.

In the lower pictures a crisscross was created by scrubbing back and forth using a composition of the invention and a microfiber cloth. The remainder of the chain had been previously cleaned with APSC and towel. The results shows that the composition of the invention removed 90% of surface and embedded soils while APSC removed only 25% of surface and embedded soils.

Figure 5:
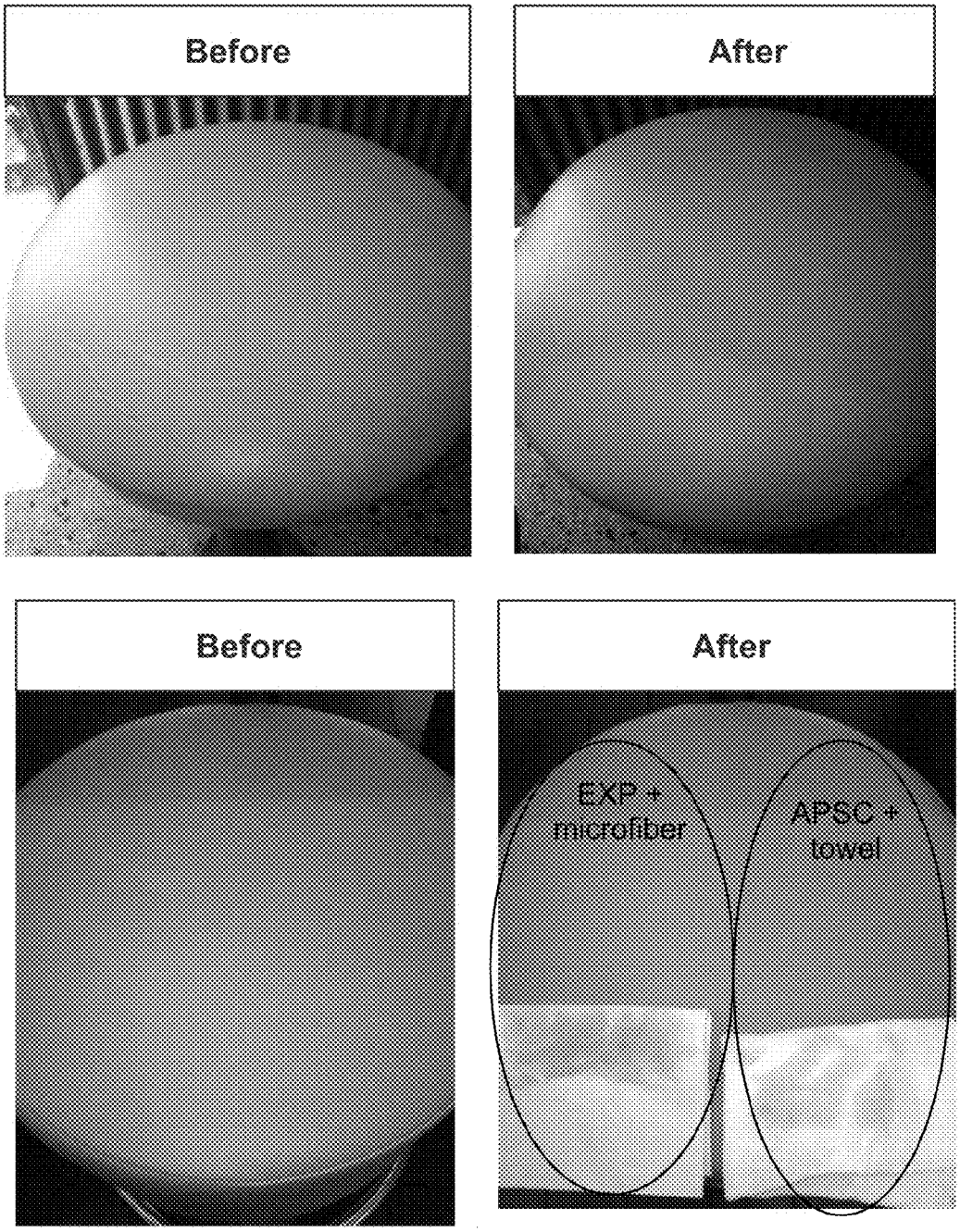
FIG. 5 includes several photographs showing testing on a leather stool before and after cleaning.

FIG. 5 shows testing on a leather stool. A composition of the invention was used in conjunction with a microfiber cloth performed very well on leather leaving the surface moisturized but not too shiny, soft to the touch with no greasy residue and demonstrating 95% soil removal from cracks and crevices of leather.

In the lower pictures the composition of the invention and microfiber removed more soils that APSC and a towel but neither product worked exceptionally well due to the unique texture of the vinyl. The composition of the invention removed approximately 60% of surface and imbedded soils while APSC removed approximately 35% of soils.

Figure 6:
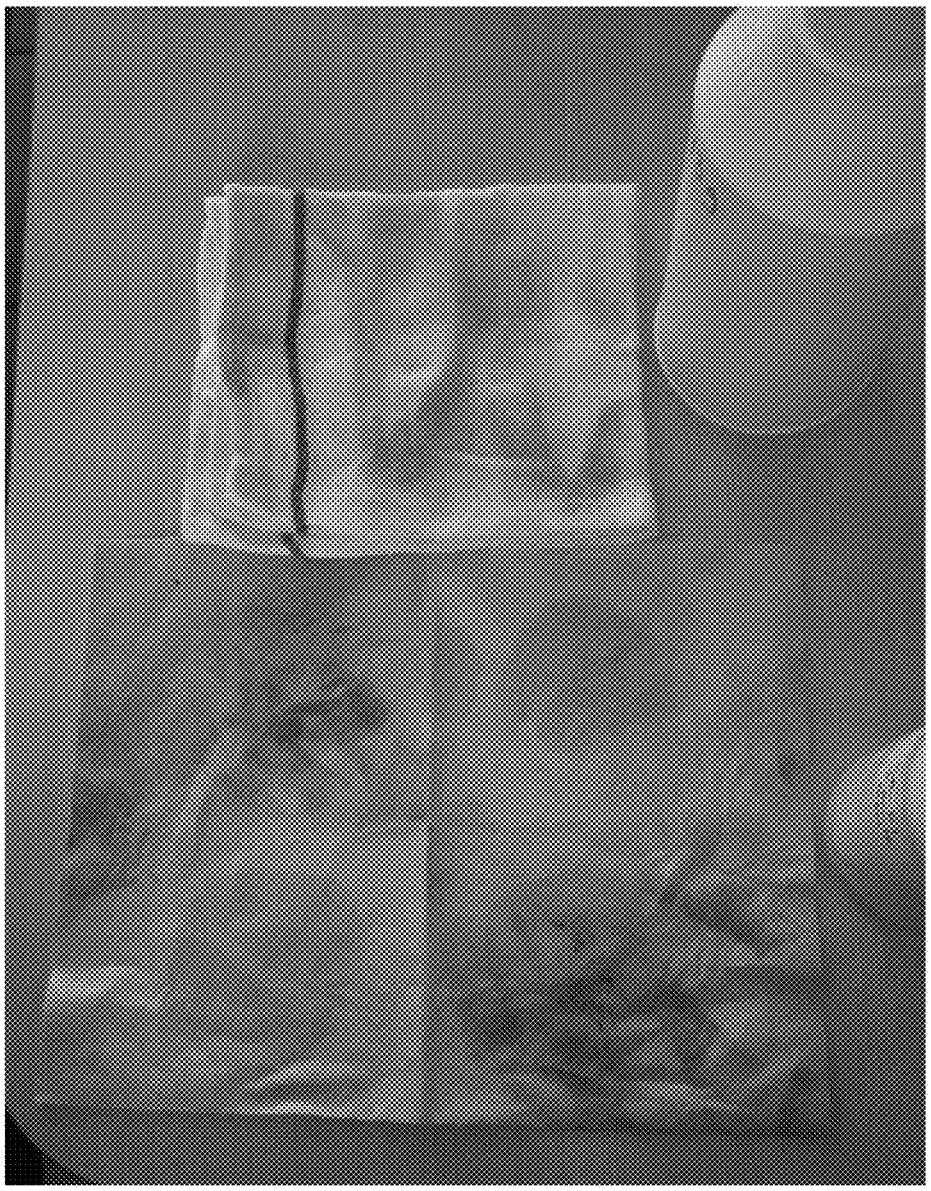
FIG. 6 is a photograph showing the remaining residue on the cleaning cloths.

FIG. 6 shows the remaining residue on the cleaning cloths. As one can see, even though the surface looked clean, there was a great deal of soil that could be removed. Table 1 below shows the onsite results of tests with the cleaner of the invention. The higher the delta E value the more soil was removed from the surface of the seating (greater color change). From the results one can see that the composition of the invention had superior cleaning to the commercially available multi-surface cleaner that does not have a surfactant combination of the invention or any moisturizers.

Field Screening Delta E Results:

| Seating Material | Product Tested | Tool Tested | Delta E | Notes |
|---|---|---|---|---|
| | Quick Service Restaurant-Jamestown, NC | | | |
| Vinyl Blue Bench | Leather/Vinyl Cleaner & Conditioner of the Invention | Microfiber Cloth | 3.26 | |
| | APSC Solution | Microfiber Cloth | 0.4 | |
| | APSC Solution | Bar Towel | 1.19 | |
| | Quick Service Restaurant-High Point, NC | | | |
| Vinyl Yellow Stool | APSC Solution | Bar Towel | 1.33 | |
| | Leather/Vinyl Cleaner & Conditioner of the Invention | Microfiber Cloth | 2.7 | |
| | Quick Service Restaurant-Greensboro, NC | | | |
| Leather Tan Stool | Leather/Vinyl Cleaner & Conditioner of the Invention | Microfiber Cloth | 7.4 | Stool 1 |
| | Leather/Vinyl Cleaner & Conditioner of the Invention | Paper Towel | 2.2 | Stool 1 |
| | Leather/Vinyl Cleaner & Conditioner of the Invention | Microfiber Cloth | 4.3 | Stool 2 |
| | Leather/Vinyl Cleaner & Conditioner of the Invention | Microfiber Cloth | 4.1 | Stool 3 |
| | Water | Microfiber Cloth | 2.82 | Stool 4 |

*Note-
The higher the delta E value, the more soil was removed from the surface of the seating (greater color change). An average of 5 measurements was taken for each reading.

Figure 7:
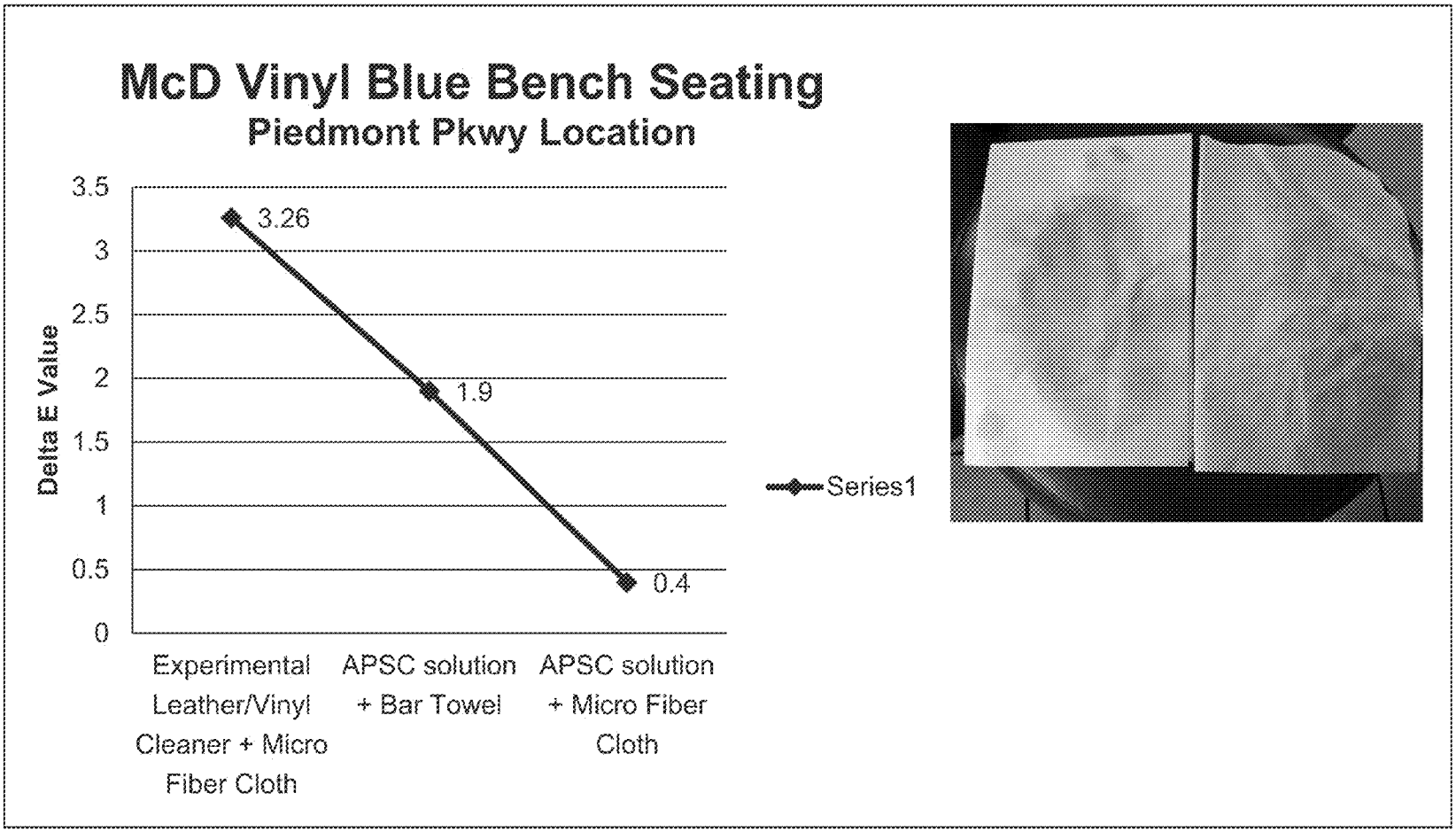
FIG. 7 is a graph showing the delta E values of the composition of the invention compared to commercial cleaners and a photograph showing the remaining residue on the cleaning clothes used.

FIG. 7 is a graph showing the delta E values of the composition of the invention compared to commercial leather/vinyl cleaners. One can see that the composition of the invention cleans much better than the commercially available cleaners. This finding is also seen in the pictures of the cloths shown next to the graph.

Figure 8:
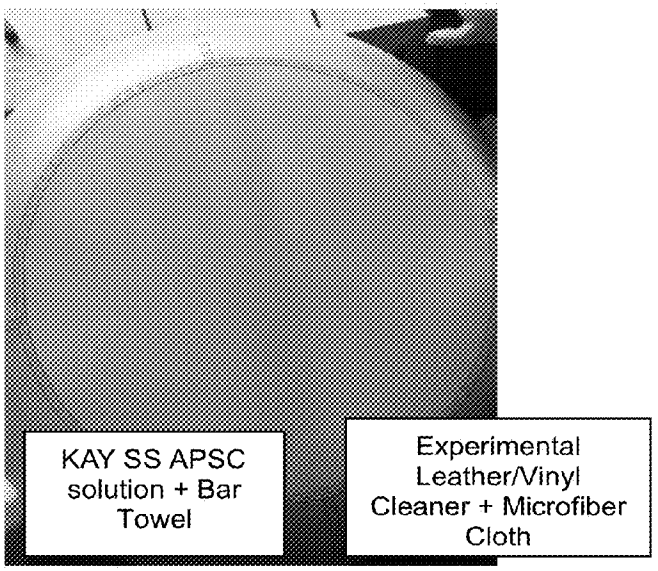
FIG. 8 shows a graph of delta E values for a yellow vinyl stool cleaning and a photograph of the stool before and after cleaning.
Figure 8:
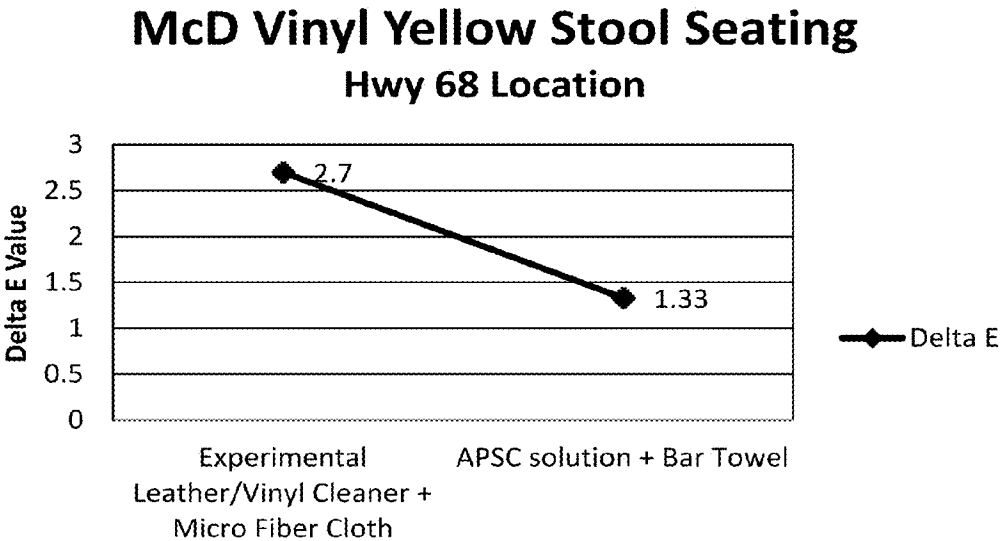

FIG. 8 shows a graph of delta E values for a yellow vinyl stool cleaning. Here again the delta E values are higher for the composition of the invention. The photograph also shows this.

Figure 9:
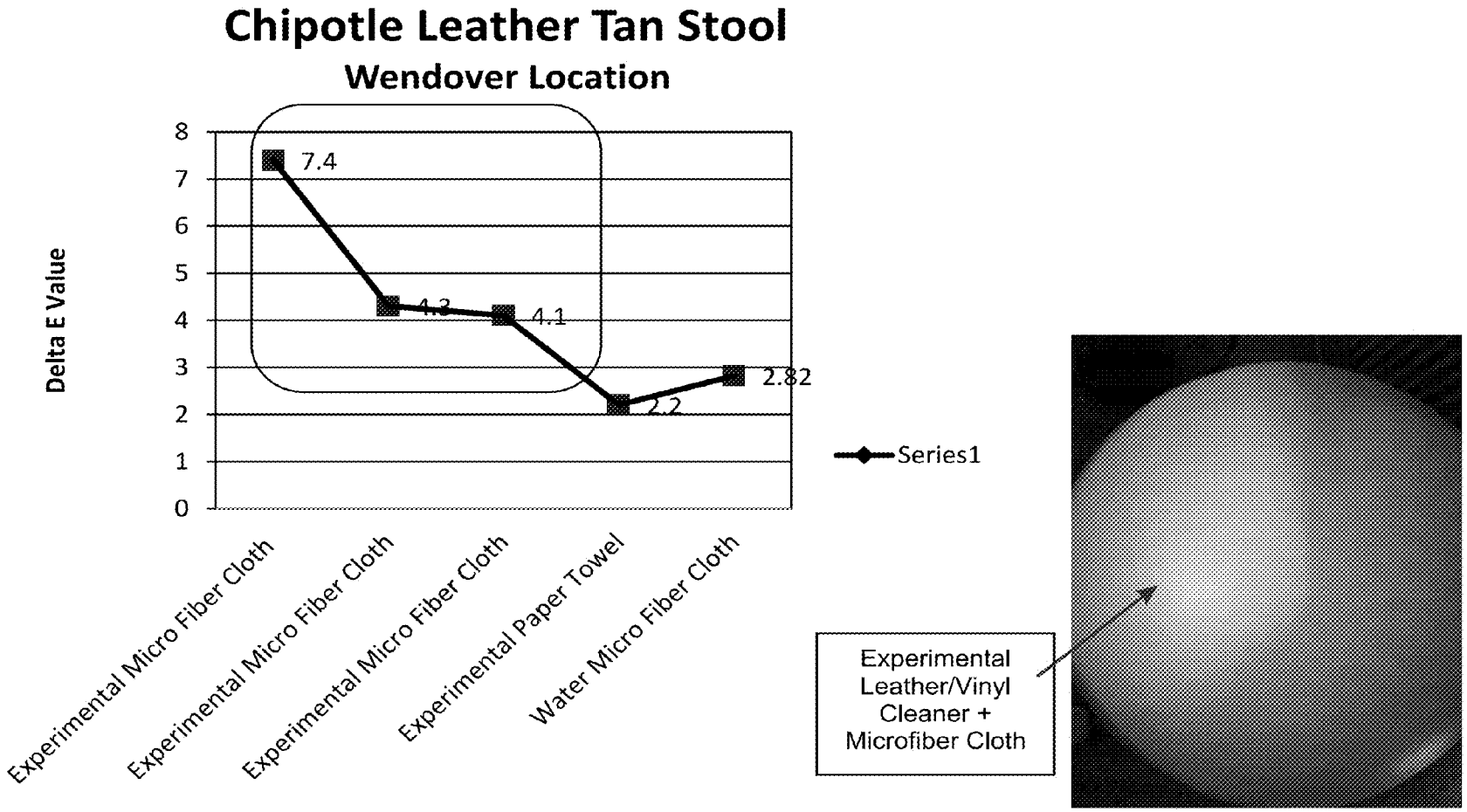
FIG. 9 shows a graph of delta E values for a leather tan stool cleaning and a photograph of the stool before and after cleaning.

FIG. 9 is a graph showing the stain removal on a leather tan stool. The composition of the invention shows much higher delta E values and thus the composition of the invention significantly removed the most soil. This is also shown pictorially in the photograph.

Figure 10:
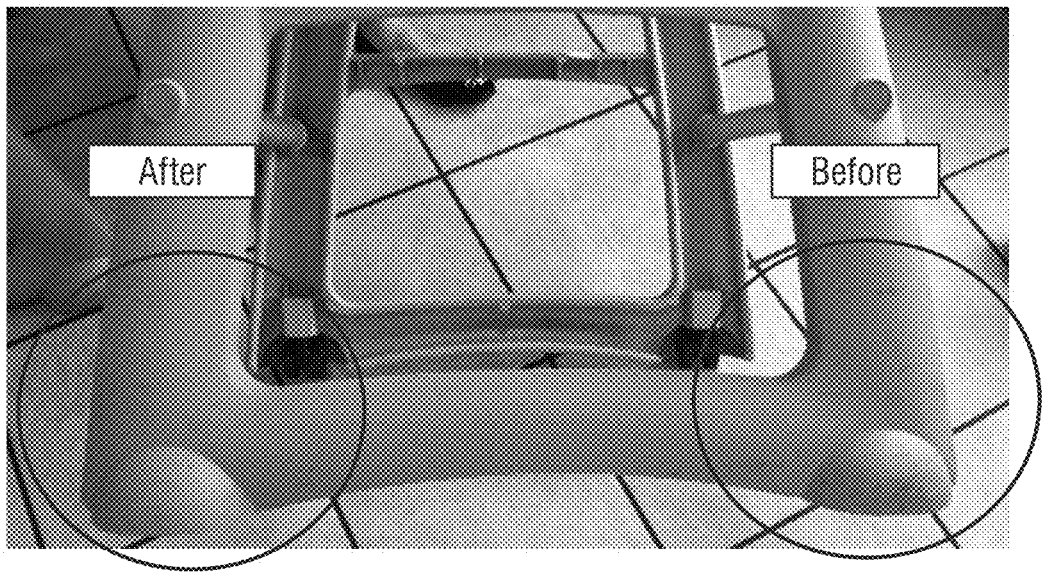
FIG. 10 is a before and after photograph of a high chair treated with the composition of the invention to remove black scuff marks.

FIG. 10 shows pictures of a high chair at a quick service restaurant. The composition of the invention was used here on black scuff marks on the bottom of the chair. The composition of the invention removed most of the scuff marks, demonstrating further uses for the cleaning composition of the invention.

Example 2

The invention also includes a specific engineering process with the emulsifier/thickener to maintain a stable emulsion. First, the thickener, preferably Xanthan Gum must be fully hydrated before combining with silicone and second the silicone must be blended with surfactants, fragrance, and buffering agent before combining with water.

First the silicone pre-mix is prepared by adding fragrance, surfactants, hydrotope, and silicone in a premix tank. The components are mixed for approximately 10 minutes for form an emulsion. Next a small amount of water is added. Next a second pre-mix is created with xanthan gum and enough water to hydrate the gum. The components are mixed for 15 minute intervals and sampled for viscosity. Viscosity may be determined by a Brookfield Viscometer Model LVDV1P115, Small Sample Adapter Spindle 21, 30 RPM and 77F. The Viscosity Range is 106-372 for the final formula, with a desired viscosity of 239.

When sufficient viscosity is achieved, the preservative and any additional surfactant is added and mixed. Finally the first pre-mix is added and the components are mixed for 15 minutes and the batch is sampled and if necessary mixed for a further amount of time until a desirable emulsion is achieved.

Achieving such a stable emulsion was quite surprising as generally, macro emulsions are thermodynamically unstable and surfactants can be used, stoichiometrically, to stabilize by reducing surface tension. However, the quantities of surfactants used in this formulation are in excess of the stoichiometric quantities, for the purpose of providing additional detergency in for the end use.

Applicants achieved stable polydimethylsiloxane and surfactant premix by emulsifying water inside. Unexpectedly, making the water in oil emulsion first made the most stable finished product. Then, the amount of water was reduced to 30% of inversion point and still achieved a stable water-in-oil premix, and a stable final product. This emulsion is quite unique in that the oil droplets in the final formula are not coalescing, and this creates a stable emulsion without high shear, and a stable emulsion without stoichiometric ratio of surfactants:polydimethylsiloxane.

What is claimed is:

1. A cleaning/treatment composition for leather, vinyl, and similar surfaces comprising:

(a) a silicone component
(b) an amine dispersant
(c) a surfactant blend comprising an alcohol alkoxylate with 3 moles of ethoxylate, a coconut derived surfactant, and a sorbitan ester;
(d) with any remainder being water or other functional components.

2. The composition of claim 1 wherein said coconut derived surfactant is cocamidopropylbetaine.

3. The composition of claim 1 wherein said alcohol alkoxylate is a C10-C12 alcohol with 3 moles of ethoxylate.

4. The composition of claim 1 where said sorbitan ester is polyoxyethylene (20) sorbitan monooleate.

5. The composition of claim 1 wherein said amine dispersant is triethanolamine.

6. The composition of claim 1 wherein said silicone is present in an amount of from about 0.01% to about 10% by weight of said composition.

7. The composition of claim 1 wherein said surfactant comprises cocamidopropylbetaine, a C10-C12 alcohol with 3 moles of ethoxylate and polyoxyethylene (20) sorbitan monooleate.

8. The composition of claim 7 wherein said components are present in a ratio of 1:1:2 by weight of the surfactant component.

9. The composition of claim 1 further comprising a thickener.

10. The composition of claim 1 further comprising a preservative.

11. A method of cleaning, preserving and protecting a leather surface comprising the steps of: contacting a leather surface with an effective cleaning amount of a cleaning composition comprising:

i) from about 0.3% to about 20%, based on weight of the cleaning composition, of a silicone derivative selected from the group consisting of polysiloxane copolymers, silicone-acrylate copolymers, silicone oils, amino-substituted silicone copolymer derivatives, and mixtures thereof;

ii) from about 0.027% to about 0.05%, based on weight of the cleaning composition, of at least one stabilizer;

iii) from about 4% to about 20%, based on weight of the cleaning composition, of a surfactant blend comprising an alcohol alkoxylate with 3 moles of ethoxylate, a coconut derived surfactant, and a sorbitan ester wherein said surfactants are mild and non-irritating to the user;

with any remainder being water and wiping said leather surface with a cloth or disposable substrate.

12. The method of claim 11 wherein said composition is a stable emulsion.

13. The method of claim 11 wherein said contacting does not leave a sticky residue.

14. The method of claim 11 wherein said composition is capable of removing mustard, non-trans fats, grease from food products, cooking grease, or ketchup from said surface.

15. The method of claim 11 wherein said surface is a seating surface, a tabletop, a countertop, a cleaning, a light fixture, wall, wall graphics, floors, window or a window treatment.

16. A method of making a cleaning/treatment composition comprising: hydrating a thickener component with water for form a first pre-mix solution;

blending surfactants with silicone to form a second pre-mix solution; and thereafter mixing said first and second premixes with further components to form a stable emulsion.

17. The method of claim 16 wherein said surfactant component comprises 70% of said pre-mix with 10% water and the remainder comprising silicone.

18. The method of claim 16 wherein said thickener is xanthan gum.

19. The method of claim 16 wherein the cleaning treatment composition includes i) from about 0.3% to about 20% of a silicone selected from the group consisting of polysiloxane copolymers, silicone-acrylate copolymers, silicone oils, amino-substituted silicone copolymer derivatives, and mixtures thereof;

ii) from about 0.027% to about 0.05%, based on weight of the cleaning composition, of at least one stabilizer;

iii) from about 4% to about 20%, based on weight of the cleaning composition, of a surfactant component including cocamidopropylbetaine, a C10-C12 alcohol with 3 moles of ethoxylate and polyoxyethylene (20) sorbitan monooleate wherein said surfactants are mild and non-irritating to the user;

iv) a preservative from about 0.12% to about 17% with any remainder being water.

20. The method of claim 16 wherein said silicone is polydimethylsiloxane.

21. The method of claim 16 wherein said emulsion is a stable emulsion without high shear.

* * * * *